US009271571B2

(12) United States Patent
DeLorean et al.

(10) Patent No.: US 9,271,571 B2
(45) **Date of Patent: *Mar. 1, 2016**

(54) RETRACTABLE VENTED ATTIC STORAGE SYSTEM

(71) Applicants: Jack Z. DeLorean, Bloomfield Village, MI (US); Mark Carpenter, White Lake, MI (US)

(72) Inventors: Jack Z. DeLorean, Bloomfield Village, MI (US); Mark Carpenter, White Lake, MI (US)

(73) Assignee: DeLorean, LLC, Bloomfield Village, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/605,322

(22) Filed: Jan. 26, 2015

(65) Prior Publication Data

US 2015/0216298 A1 Aug. 6, 2015

Related U.S. Application Data

(63) Continuation-in-part of application No. 14/451,081, filed on Aug. 4, 2014, now abandoned, which is a continuation-in-part of application No. 13/968,229, filed on Aug. 15, 2013, now Pat. No. 8,820,003.

(60) Provisional application No. 61/692,147, filed on Aug. 22, 2012.

(51) Int. Cl.

| | |
|---|---|
| ***A47B 46/00*** | (2006.01) |
| ***F24F 7/007*** | (2006.01) |
| ***A47B 51/00*** | (2006.01) |
| ***E04B 9/00*** | (2006.01) |
| ***E04B 9/02*** | (2006.01) |
| ***F24F 13/20*** | (2006.01) |

(52) U.S. Cl.

CPC ..... *A47B 46/005* (2013.01); *A47B 51/00* (2013.01); *E04B 9/003* (2013.01); *E04B 9/02* (2013.01); *F24F 7/007* (2013.01); *F24F 13/20* (2013.01); *A47B 2051/005* (2013.01); *E04B 9/006* (2013.01)

(58) Field of Classification Search

CPC .. A47B 51/00; A47B 2051/005; E04B 9/003; E04B 9/02; B66B 9/00; F24F 7/007

USPC ..... 52/29, 67; 312/242, 245–247; 414/267, 414/281

See application file for complete search history.

(56) References Cited

U.S. PATENT DOCUMENTS

| | | | | |
|---|---|---|---|---|
| 982,056 | A * | 1/1911 | Hammell | 62/260 |
| 2,086,002 | A * | 7/1937 | Shepard | 187/255 |
| 2,382,354 | A * | 8/1945 | Wales | 312/247 |

(Continued)

*Primary Examiner* — Robert Canfield
(74) *Attorney, Agent, or Firm* — David Pressman

(57) ABSTRACT

A closet or enclosure 100 (closet) fit into an attic. A panel (110) forms the bottom of the closet. The panel can be lowered to the living space below manually or by using a return spring or electrical means. The panel holds a cabinet, box, or other storage item (105 or 2225). Air space (150) around the cabinet or items insulates it from thermal contact with the walls. Alternatively a cabinet is hung from a restraining member (145), or arm (1105), so it can be raised for storage and lowered for access. In this aspect, the panel is secured to the bottom of the cabinet. Optional vents (155) and fan (160) urge circulation between the air space and the living space, reducing temperature extremes in the air space and hence the cabinet. In other aspects, air treatment units (HVAC, dehumidifier, etc.) condition the air within the closet or enclosure.

17 Claims, 23 Drawing Sheets

(56) References Cited

U.S. PATENT DOCUMENTS

| | | | | | |
|---|---|---|---|---|---|
| 2,499,791 | A * | 3/1950 | Spencer | 312/247 |
| 2,506,086 | A * | 5/1950 | Jess | 312/247 |
| 2,555,254 | A * | 5/1951 | Stebbins | 312/319.7 |
| 3,415,586 | A * | 12/1968 | Hammond | 312/312 |
| 3,467,460 | A * | 9/1969 | Acker | 312/242 |
| 3,608,674 | A * | 9/1971 | Phillips | 187/270 |
| 4,412,601 | A * | 11/1983 | Cooper | 312/242 |
| 5,203,619 | A * | 4/1993 | Welsch et al. | 312/247 |
| 5,475,949 | A * | 12/1995 | McCoy | 52/67 |
| 5,535,852 | A * | 7/1996 | Bishop et al. | 187/336 |
| 5,667,035 | A * | 9/1997 | Hughes | 182/142 |
| 6,250,728 | B1 * | 6/2001 | Thorp | 312/247 |
| 6,336,692 | B1 * | 1/2002 | Snyder | 312/312 |
| 6,755,492 | B1 * | 6/2004 | Hyde et al. | 312/247 |
| 7,246,865 | B1 * | 7/2007 | Merrell, II | 312/248 |
| 2005/0098387 | A1 * | 5/2005 | Penn et al. | 187/262 |
| 2005/0248241 | A1 * | 11/2005 | Ceglarski | 312/245 |
| 2006/0066188 | A1 * | 3/2006 | Crawford | 312/247 |
| 2008/0289264 | A1 * | 11/2008 | Bowman | 52/29 |
| 2014/0252930 | A1 * | 9/2014 | Reid et al. | 312/247 |

* cited by examiner

Fig. 10
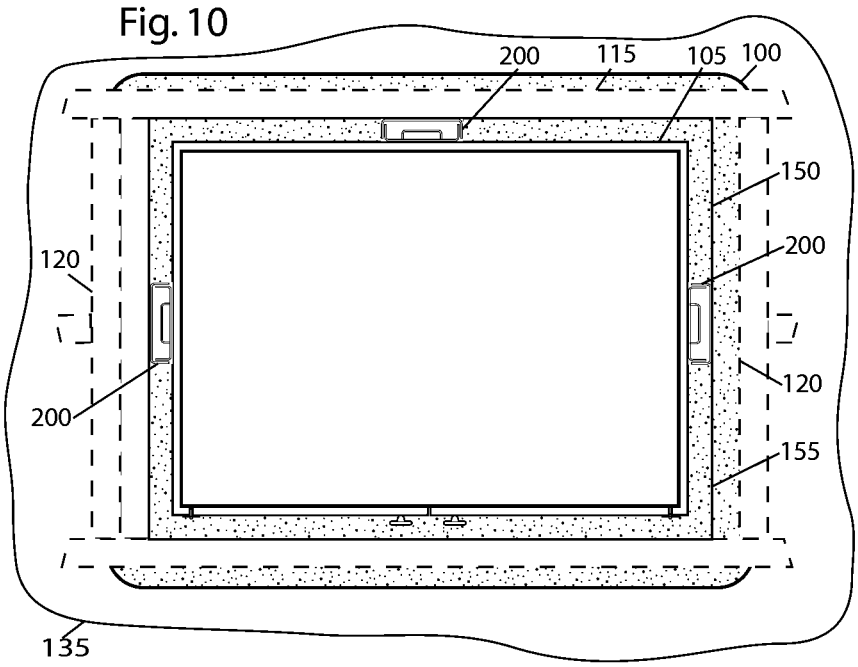
Fig. 11A
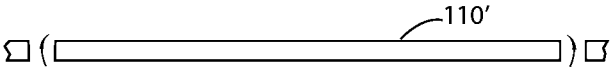
Fig. 11B
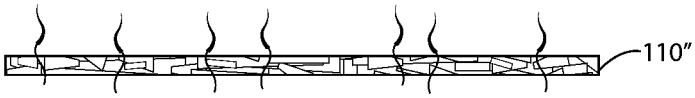
Fig. 11C
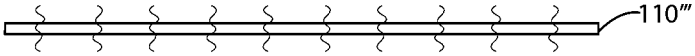
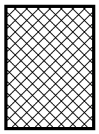
Fig. 11D
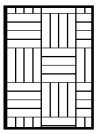
Fig. 11E
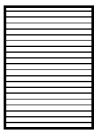
Fig. 11F
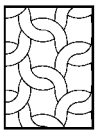
Fig. 11G
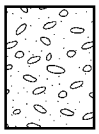
Fig. 11H To energy source
2521

145
145
2520
142
140
141
150
142
140
141
105′
100′
2525
2000
2000
2000
2000
2523
115
2110
2110
115
155
108
110
135
120
108″
108′
160
400L
108
106
106
108
400R
108
108′
155
135
120
108″
300

*Air treatment unit:
Air conditioner, heater, heat pump, dehumidifier, heat recovery ventilator, energy recovery ventilator, evaporative cooler, air handler or HVAC unit.

*Air treatment unit:
Air conditioner, heater, heat pump, dehumidifier, heat recovery ventilator, energy recovery ventilator, evaporative cooler, air handler or HVAC unit.

RETRACTABLE VENTED ATTIC STORAGE SYSTEM

CROSS-REFERENCE TO RELATED APPLICATIONS

This application is a Continuation-in-Part (CIP) of application Ser. No. 14/451,081, Filed 2014 Aug. 4, now abandoned.

The '081 application is a CIP of application Ser. No. 13/968,229, Filed 2013 Aug. 15, now U.S. Pat. No. 8,820,003, Granted 2014 Sep. 2.

The '229 application claims priority of Provisional Patent Application Ser. No. 61/692,147, Filed 2012 Aug. 22.

BACKGROUND

Prior Art—Attic Closets

Home attic areas provide cost-free and nearby storage space. However access is generally difficult, even with attic ladders. Such ladders are often quite narrow and difficult to navigate, especially while carrying items to and from storage. Summer temperatures in some attics approach 65° C. (150° F.), which can be damaging to clothing, shoes, books, photographs, and other stored goods.

To take advantage of this cost-free and nearby storage space, homeowners have used closets in their attics, to facilitate orderly storage. However previous arrangements using closets and other devices have various disadvantages. The following is a list and a discussion of some possibly relevant prior art that shows a variety of attic storage arrangements.

| U.S. Utility Patents | | | |
|---|---|---|---|
| Patent or Pub. Nr. | Kind Code | Issue or Pub. Date | Patentee or Applicant |
| 2,499,791 | B1 | 1950 Mar. 7 | Spencer |
| 3,467,460 | B1 | 1969 Sep. 16 | Acker |
| 4,344,505 | B1 | 1982 Aug. 17 | Waters et al. |
| 4,412,601 | B1 | 1983 Nov. 1 | Cooper |
| 4,658,555 | B1 | 1987 Apr. 21 | Steiner |
| 5,475,949 | B1 | 1995 Dec. 19 | McCoy |
| 5,667,035 | B1 | 1997 Sep. 16 | Hughes |
| 6,095,344 | B1 | 2000 Aug. 1 | White |
| 6,223,490 | B1 | 2001 May 1 | Wessley et al. |
| 6,250,728 | B1 | 2001 Jun. 26 | Thorp |
| 6,547,183 | B2 | 2003 Apr. 15 | Farnsworth |
| 7,246,865 | B1 | 2007 Jul. 24 | Merrell |
| 7,690,165 | B2 | 2010 Apr. 6 | Taylor |
| 7,841,134 | B2 | 2010 Apr. 30 | Verry |
| 7,926,229 | B2 | 2011 Apr. 19 | Melesky |
| 8,136,897 | B2 | 2012 Mar. 20 | Mascari |
| 8,157,108 | B1 | 2012 Apr. 17 | Waldrop |
| 8,162,159 | B2 | 2012 Apr. 24 | Carter |
| 8,292,031 | B2 | 2012 Oct. 23 | Penn et al. |
| 8,418,814 | B1 | 2013 Apr. 16 | Byers |
| U.S. Design Patents | | | |
| D480,892 | S | 2003 Oct. 21 | White |
| U.S. Published Patent Applications | | | |
| 2002/0117077 | A1 | 2002 Aug. 29 | Johannes |
| 2006/0066188 | A1 | 2006 Mar. 30 | Crawford |
| 2008/0289264 | A1 | 2008 Nov. 27 | Bowman |
| 2008/0296089 | A1 | 2008 Dec. 4 | Penn et al. |
| 2012/0186179 | A1 | 2012 Jul. 26 | Melesky |
| 2010/0099346 | A1 | 2012 Apr. 22 | Browne |

-continued

| U.S. Utility Patents | | | | |
|---|---|---|---|---|
| Foreign Patent Documents | | | | |
| Foreign Doc. Nr. | Country Code | Kind Code | Publication Date | Patentee/ Applicant |
| 2,253,994 | GB | A1 | 1992 Sep. 30 | Acton |
| EP0794278 | EP | A1 | 1997 Oct. 9 | Gessner |

Spencer shows a "disappearing closet" that retracts into the attic but there is no enclosure in the attic. The closet can be moved by a motor system through a framed hole in the ceiling into the attic. The motor system is secured at the upper ends of studs that run between the attic floor and the roof.

Acker also shows an enclosure that is mounted in the floor above. A closet can be moved by a motor system through a hole in the ceiling into an enclosure. The retractable closets of Spencer and Acker are subject to the aforementioned attic heat and the harm that such heat can wreak on the closer's contents.

Waters et al. shows a moveable insulating block above an attic opening that is similar in function to Melesky and Verry, below.

Cooper discloses an "elevator lift system" that can retract a platform into an enclosure in the floor above. While Cooper shows an enclosure in the floor above, it would be difficult to load storable items into this closet because one must use an awkward elevator platform.

Steiner shows an insulating cover for an attic opening that is similar to Melesky and Verry, below.

McCoy also shows an enclosure that is mounted in the floor above. A closet can be moved by a motor system through a hole in the ceiling into the enclosure.

Hughes discloses another motorized lift system similar to that of Penn, below. Penn and Hughes have closets that are subject to the aforementioned attic heat and the harm that such heat can wreak on the closer's contents.

White shows an enclosure that slides over the top of a cabinet with shelves.

Wessley et al. shows an insulating cover for an attic entrance, called a scuttle hole.

Thorp shows a closet which is retractable into an enclosure in the ceiling and is suspended by pulleys.

Farnsworth shows a vertically retractable closet for an airplane so that when raised into an enclosure above, the space can be used to allow a seat to recline.

Merrell '865 and Merrell '580 show a shelf unit that pivots into an enclosure in the floor above. McCoy, Thorp, Farnsworth, White, Johannes, and Merrell again have closet that are subject to the aforementioned attic heat and the harm that such heat can wreak on the closer's contents.

Taylor shows an insulating cover for an attic opening that is similar to Melesky and Verry.

Verry shows an insulating cover for pull-down stairs. It is similar to Melesky in that the cover in the attic is more insulating that the bottom cover.

Melesky (patent and published patent application) shows in FIG. 1 a top 28 and sides 24 of a housing in the attic which is more insulating than a bottom or ceiling cover 14.

Mascari discloses a hinged, telescoping storage container for attachment to a ceiling attic.

Waldrop discloses a drop-down shelf storage system.

Carter discloses a modular storage unit for a garage platform.

Penn et al. (patent and published patent application) shows a platform lift system that raises a platform for holding objects into the attic or floor above.

Byers discloses primarily a lift mechanism for storing objects in an attic storage. The objects are lifted up through a portal.

White shows a set of shelves that slides up on tracks into an enclosure (or vice versa).

Johannes shows a container which can be raised toward the ceiling of a garage by a motorized system.

Crawford shows an enclosure that is mounted in the floor above. A rack of shelves can be moved by a motor system through a hole in the ceiling into the enclosure in the floor above. The enclosure may be insulated. However such insulation will not eliminate all of the effects of attic heat, especially when the enclosure is exposed to the heat for a long period of time.

Bowman also shows an enclosure that is mounted in the floor above. A closet can be moved by a motor system through a hole in the ceiling into the enclosure.

Melesky discloses a manually positioned insulated cover for an access opening to a space within a building, such as an attic.

Browne shows a pressure relief valve with a flap opening actuator, coupling a compartment to an exterior environment.

Acton discloses a wardrobe 2 that retracts into attic enclosure 1.

Gessner shows a cabinet on a pedestal with ventilation openings, used for drying wet shoes and clothing apparel.

While the above-described closets are each useful for their intended purposes, each has one or more disadvantages as noted.

SUMMARY

For use in a house or other building with first and second rooms where the second room, usually an attic or room above the first or below room, the present system enables a storage item such as a cabinet or box (cabinet) to be moved from the room below to the room above. The system, in one or more aspects, overcomes one or more of the deficiencies of prior-art attic closets. In particular, an insulated closet or enclosure (closet) is installed in an attic, room or other overhead space. A panel for storing items is suspended from the room above or closet by one or more cables. A motive source raises the panel from the room below up into the closet for stowage and lowers the panel to the room below for access to its contents. In one aspect, when the panel is stowed it is flush against the ceiling of the room below. When stowed, the items are thermally insulated from the inner closet walls by an air space. One or more vent openings in the panel permit circulation and exchange of the air in the living space with that in the air space inside the closet. The mixing of higher temperature air from the living space and lower temperature air in the closet results in a generally higher temperature in the closet, helping to prevent freezing temperatures from occurring in the closet. Similarly, when the attic is hot, cooler air from the living space can mix with the air in the closet, and help to reduce the difference in temperatures therebetween. Thus temperature swings within the closet are minimized and the contents of the closet are preserved. Different aspects of various embodiments include an electrical fan for additional airflow, spring-loaded vent opening doors normally restrained with fusible fire links to prevent fire in the living space from entering the attic, insulated outer doors on the cabinet, a cabinet for storage bins, an empty cabinet for transporting objects between an attic and the living space, and an alternative manually operated support for the cabinet. Additionally, a fan can also be a component of an air treatment system such as an air conditioner, a heat recovery ventilator, an energy recovery ventilator, a heater, a heat pump, a dehumidifier, an evaporative cooler, an air handler or a heating, ventilating. and air conditioning unit to control air quality within the closet or enclosure and/or the living space.

DRAWING FIGURES

FIG. 10 shows an arrangement without a panel and including telescoping slides.

FIGS. 11A to 11C show side views of various aspects of panels.

FIGS. 11D to 11H show plan views of coverings for vent openings in panels.

Figures 20A, 20B, 20C:
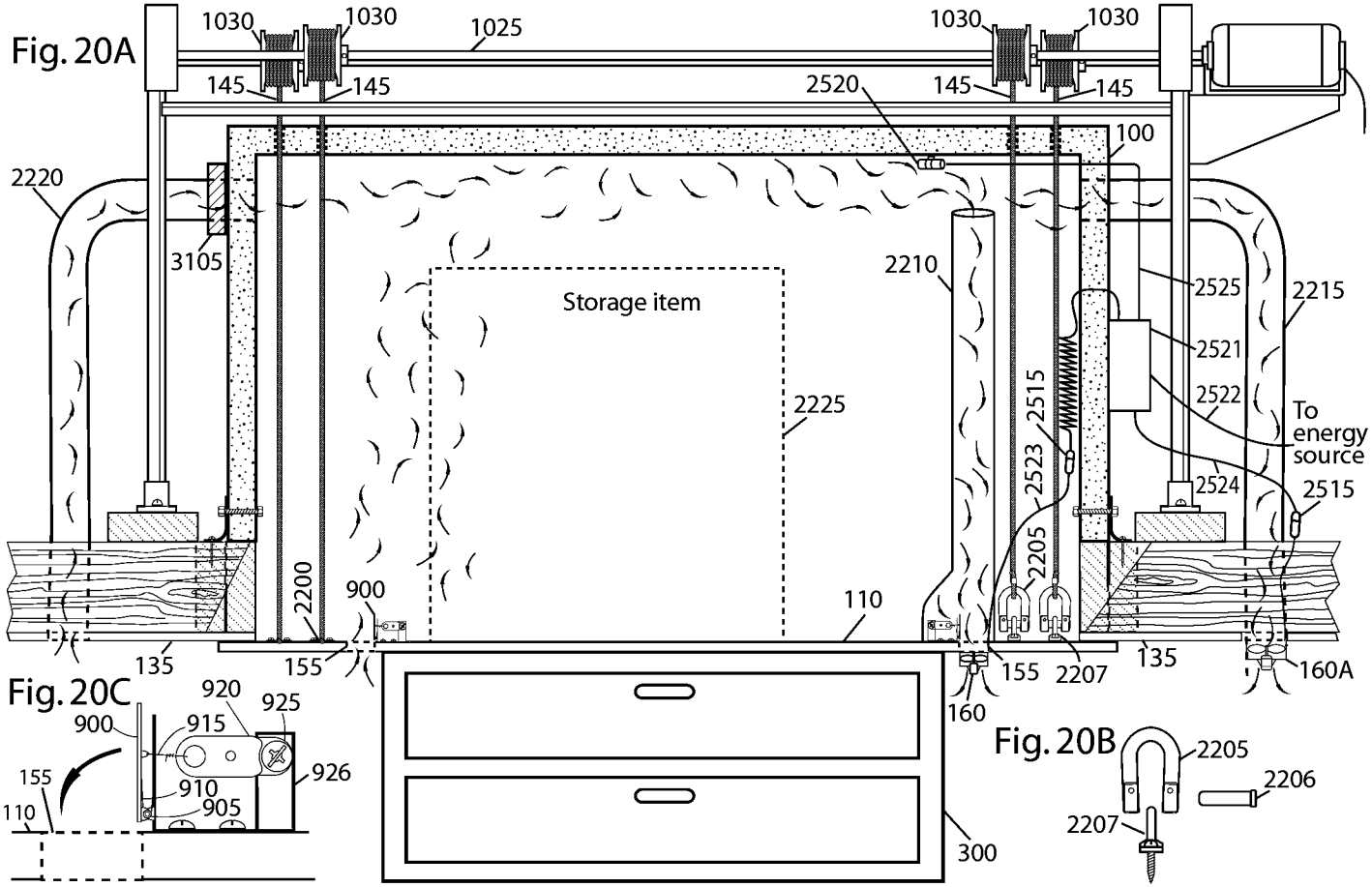

FIGS. 20A, 20B, and 20C show various aspects of a vented closet with a replaceable panel from which an accessory cabinet is suspended.

Figure 21:
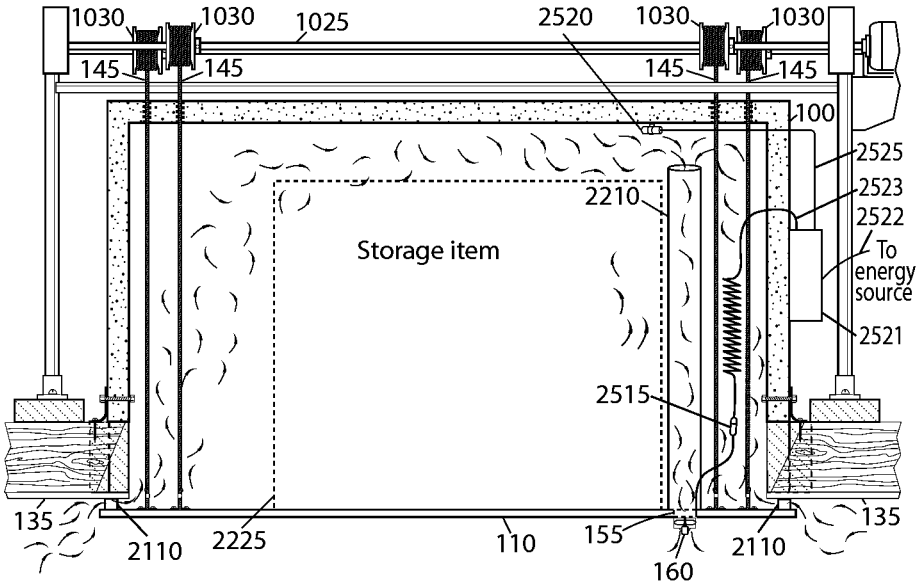
Figure 22:
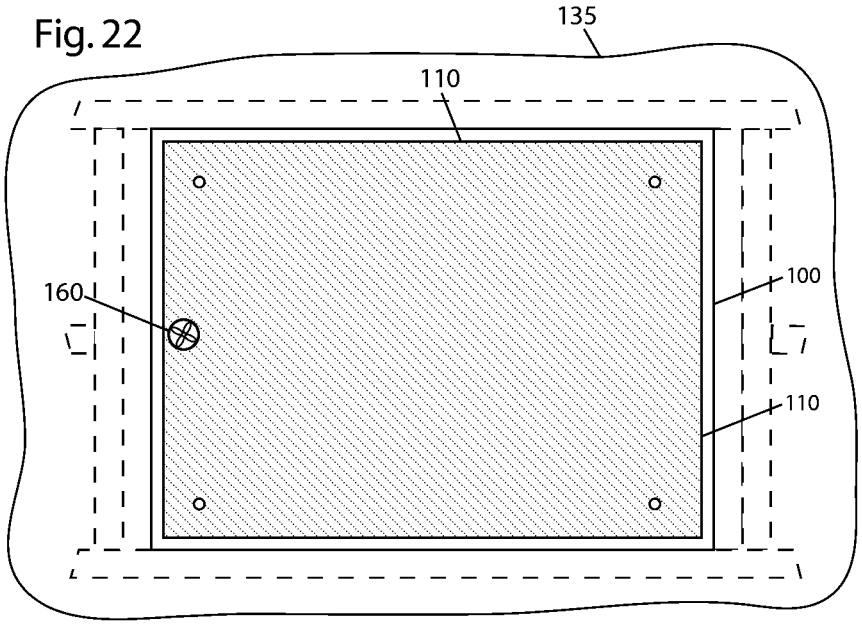

FIGS. 21 and 22 show panels that do not seal a ceiling opening.

Figures 23, 24:
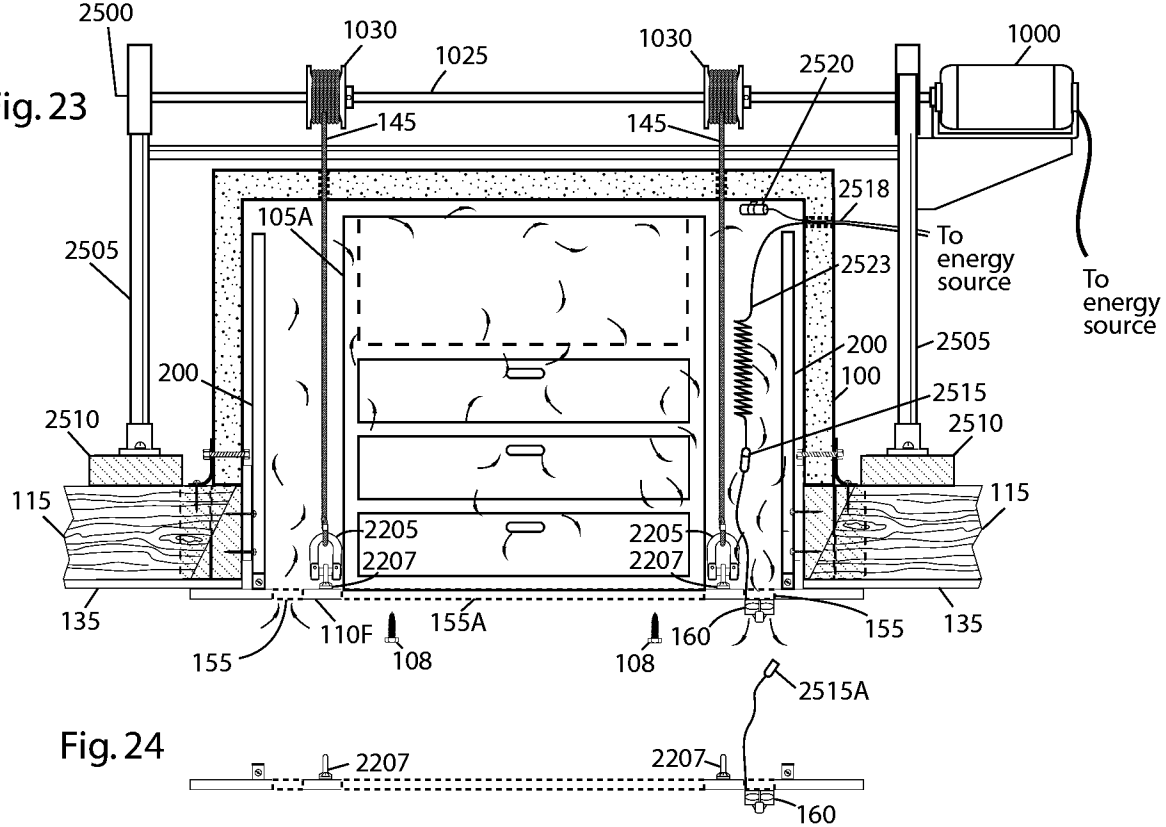

FIGS. 23 and 24 show an exchangeable optional cabinet type.

Figure 25:
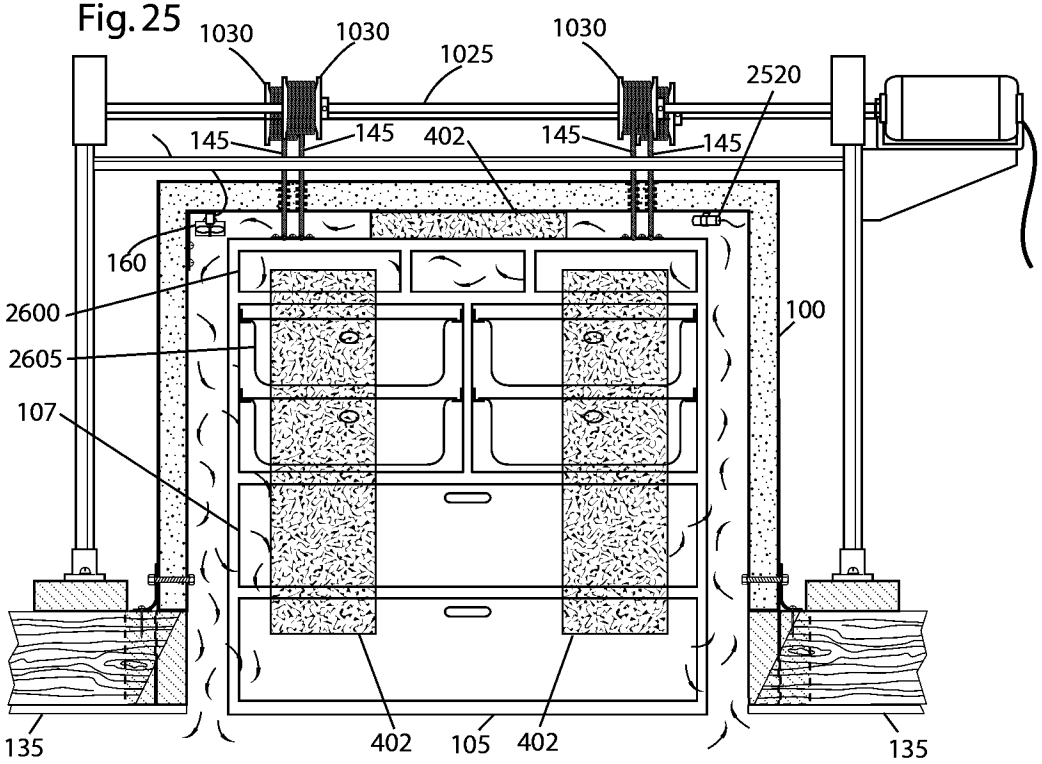

FIG. 25 shows an optional cabinet that is suspended from its top by a plurality of cables, and has no panel.

Figure 26:
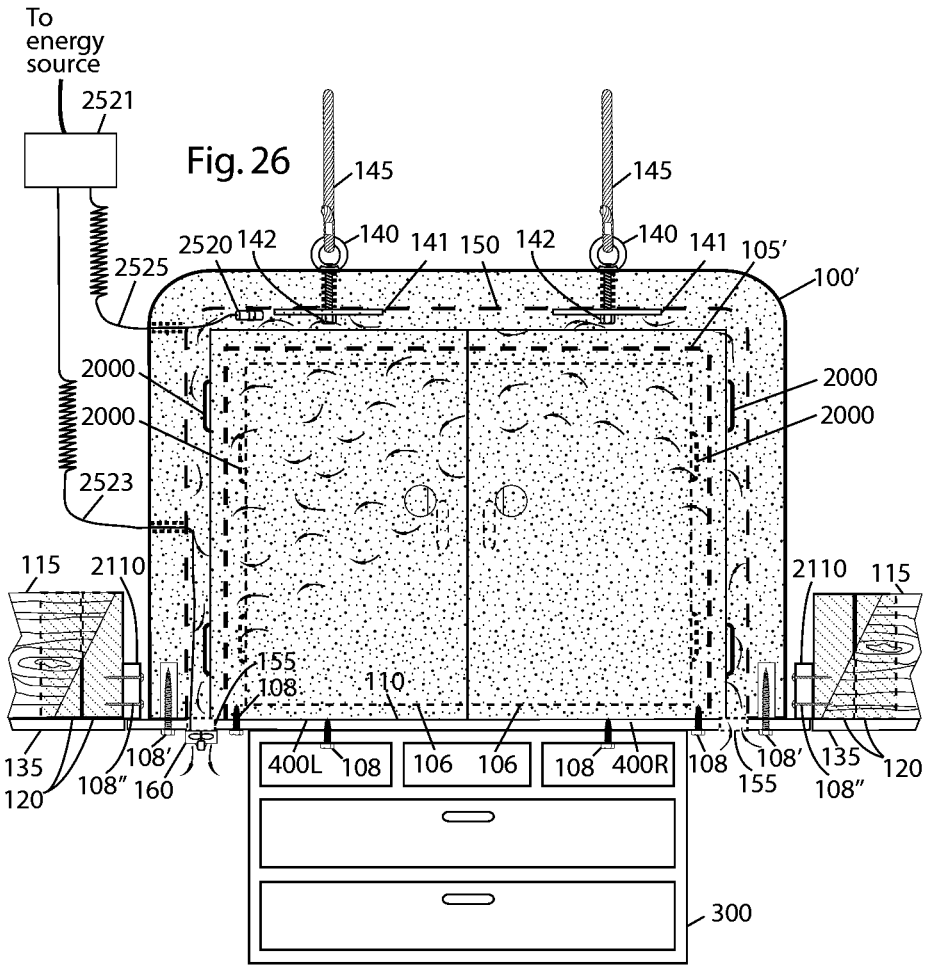
Figure 27:
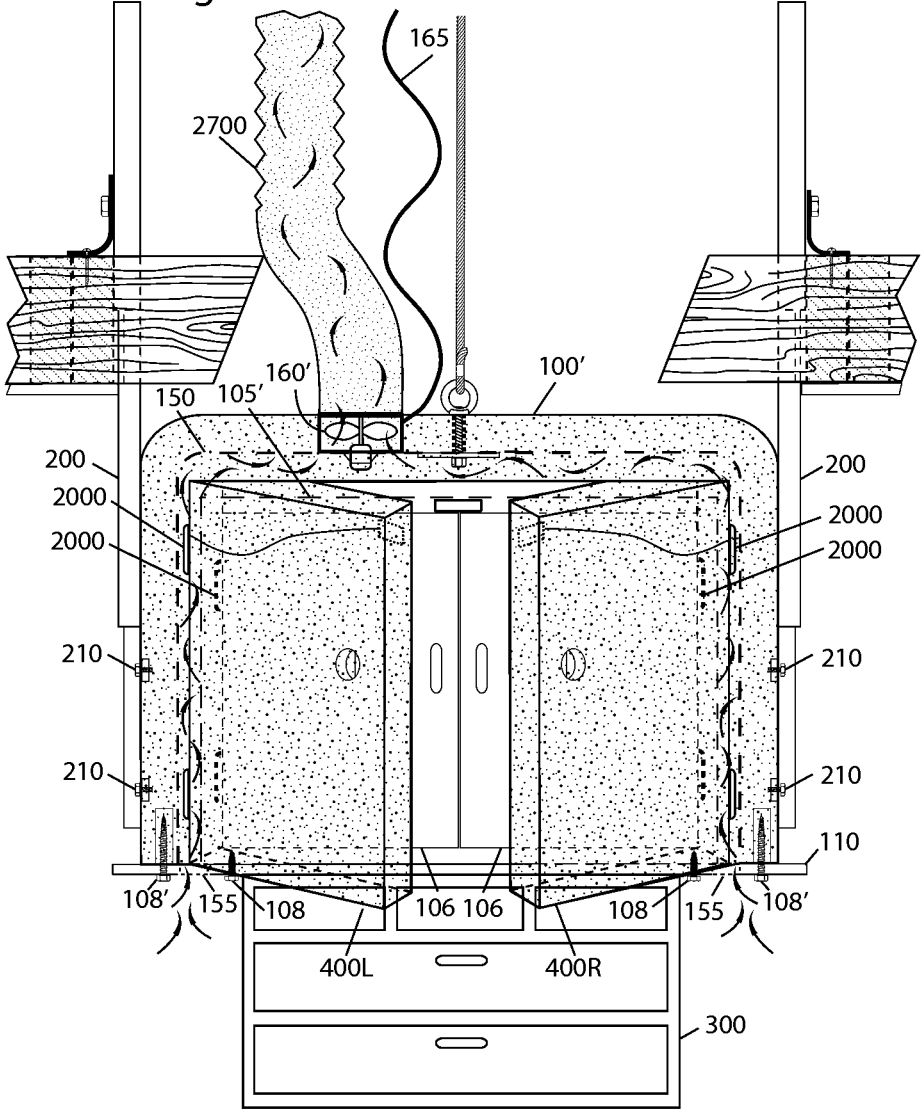
Figure 28:
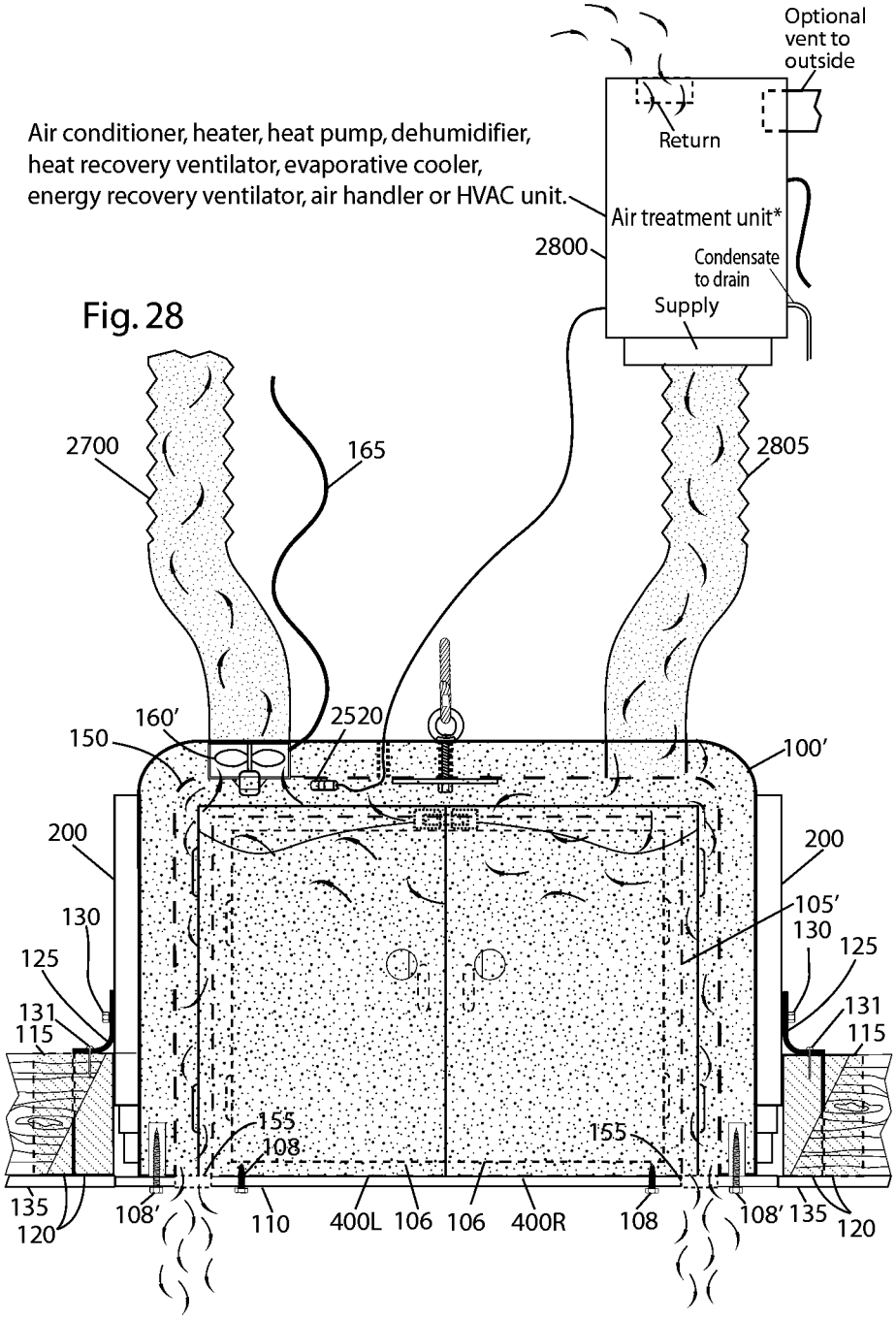

FIGS. 26 to 28 show an integrated cabinet and closet unit that is lowered into a room below. An optional accessory cabinet is hung from a panel and various venting arrangements are shown.

Figures 29, 30:
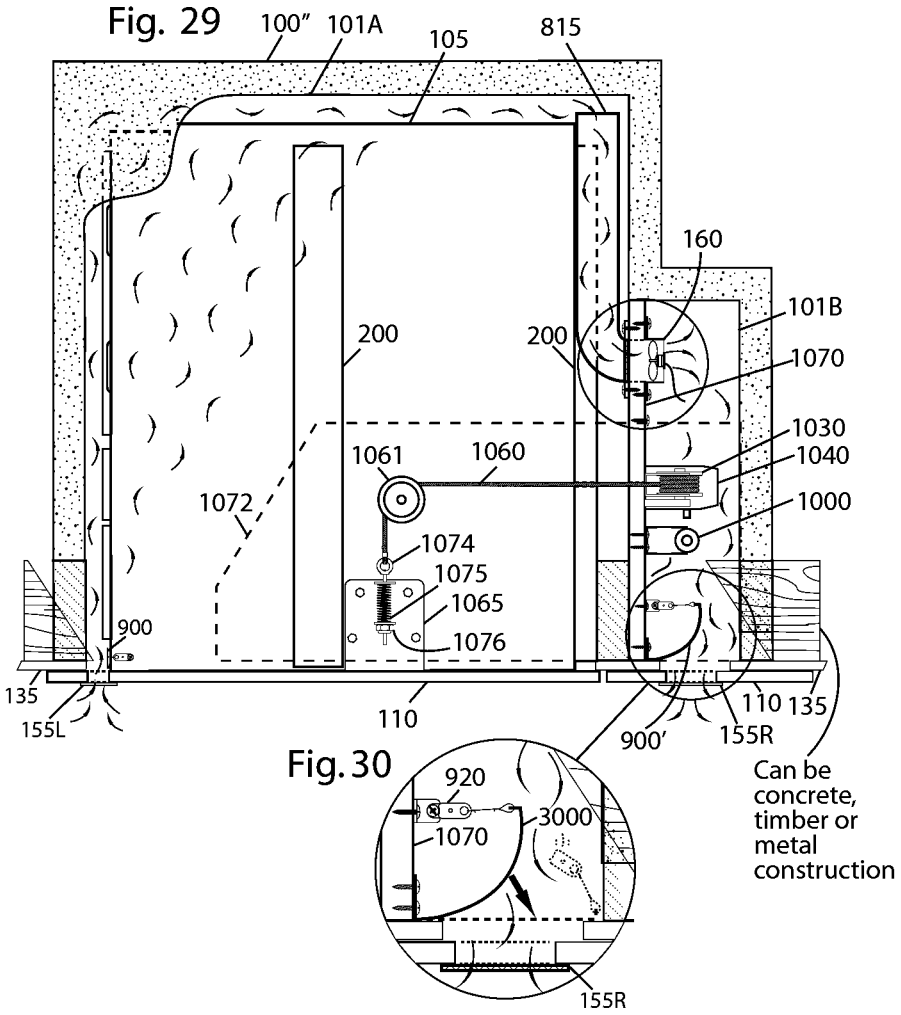

FIGS. 29 and 30 show an alternative closet design and fire door.

FIGS. 31 to 33B show various aspects of ducted closets with air treatment units.

Figure 34:
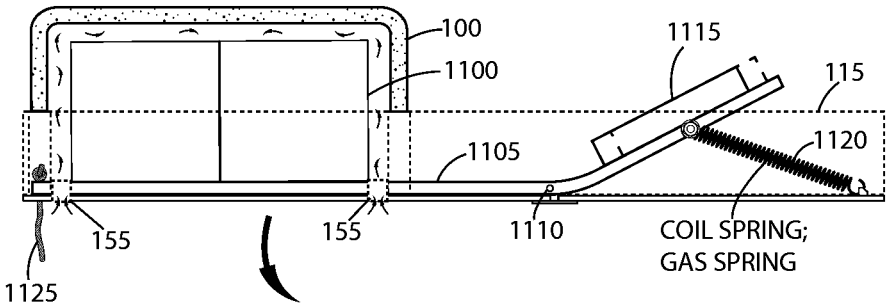
Figure 35:
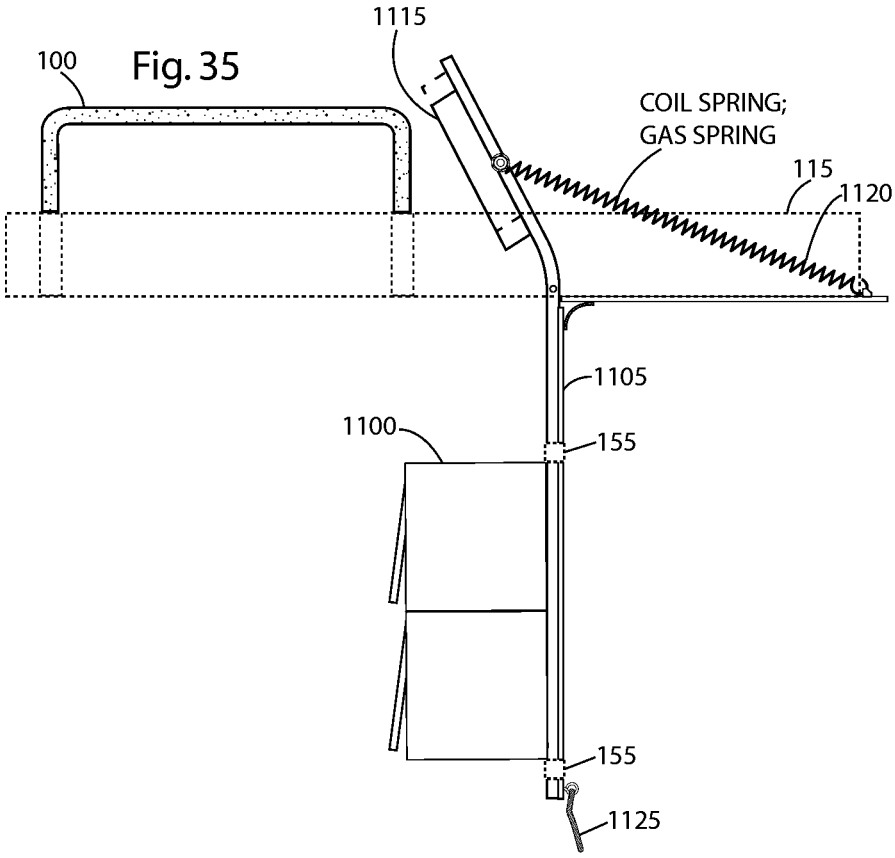

FIGS. 34 and 35 show side cut-away views of a manually operated mechanism, in this case a cantilever system for raising and lowering a tiltable cabinet 1100 that is arranged to pivot into and out of closet 100 in an attic.

Figure 36:
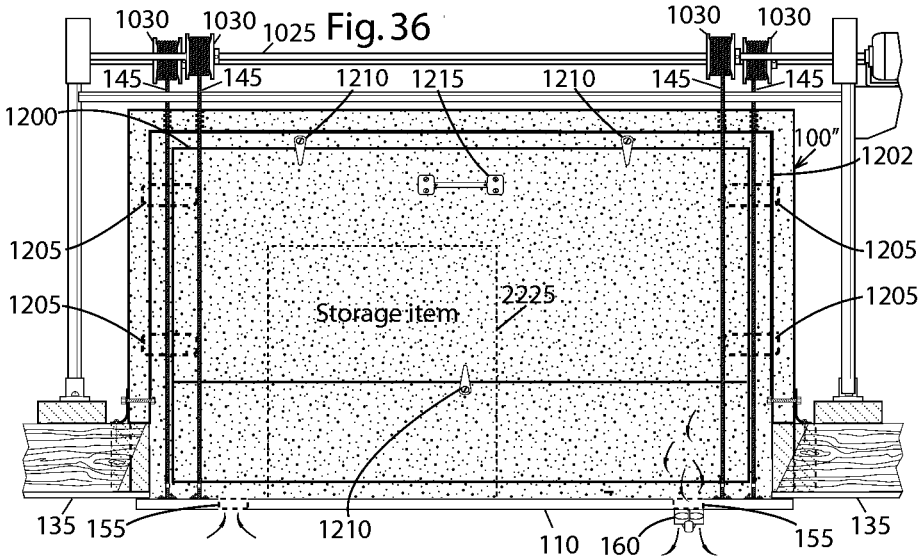
Figure 37:
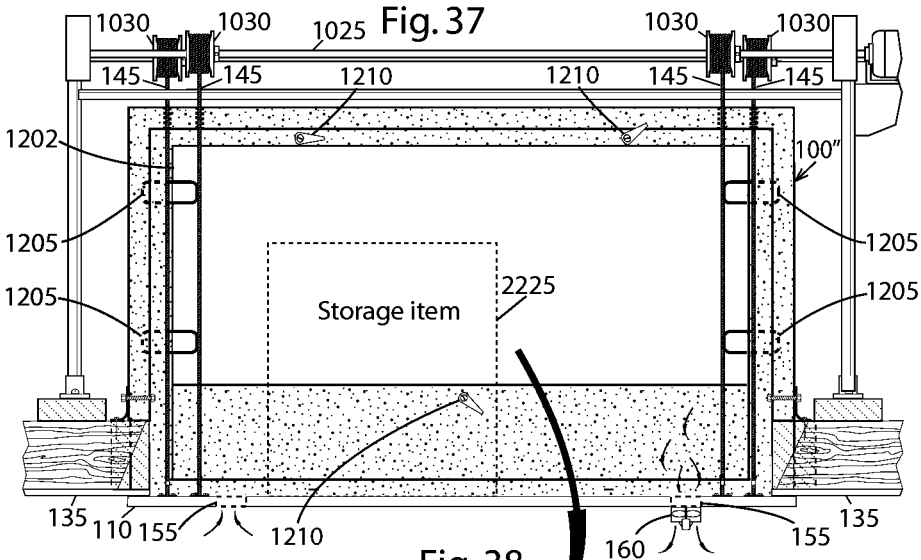

FIGS. 36 and 37 show side cut-away views of a closet with a removable access panel.

Figure 39:
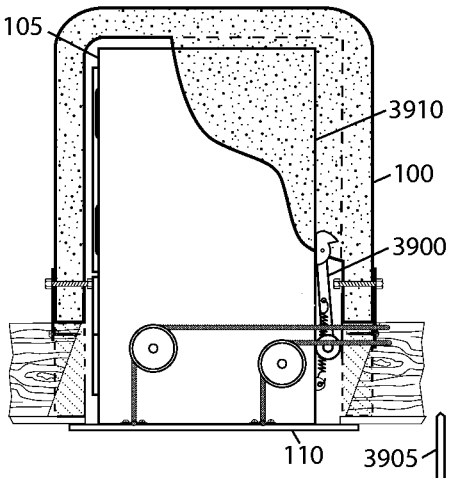
Figure 40:
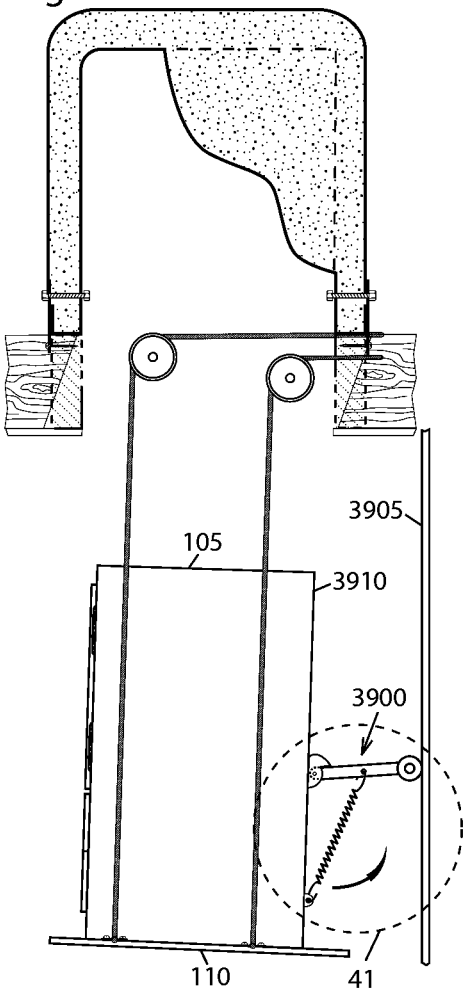
Figure 41:
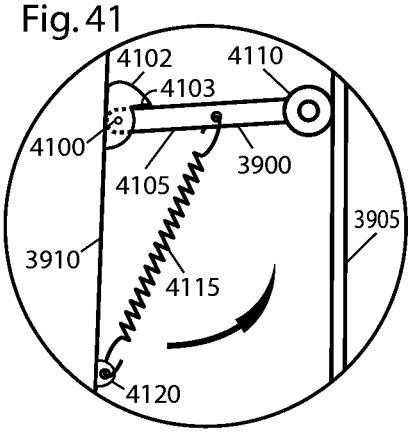

FIGS. 39 to 41 show side views of a closet, a cabinet, and a stabilizing mechanism for supporting the cabinet against a wall.

Figure 43:
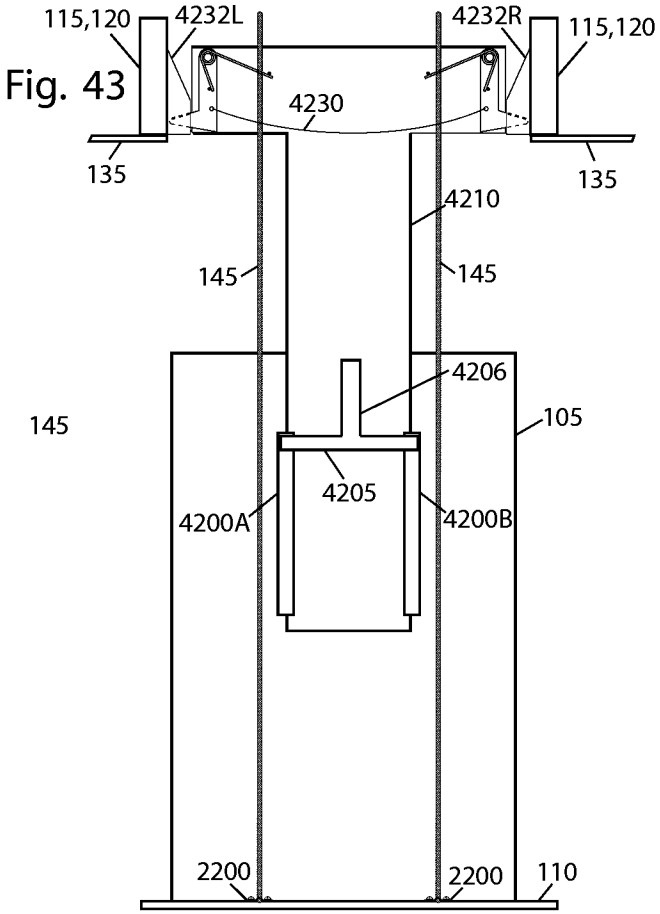
Figure 42:
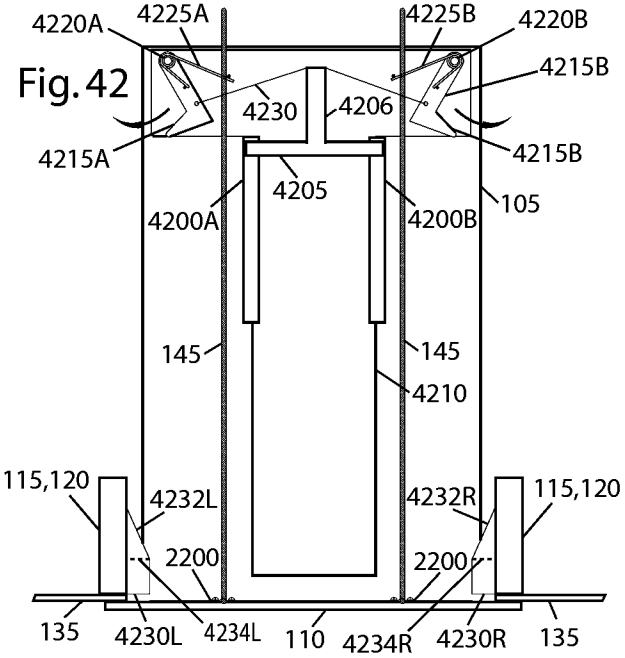

FIGS. 42 and 43 show side views of a slide mechanism for stabilizing a cabinet in a lowered position.

DRAWING REFERENCE NUMERALS

| | | | |
|---|---|---|---|
| 100 | Closet or enclosure (closet) | 101 | Chamber |
| 104 | Hinge | 105 | Cabinet or box |
| 106 | Door | 107 | Drawer |
| 108 | Fastener | 110 | Panel |
| 115 | Joist | 120 | Framing member |
| 125 | Bracket | 130 | Fastener |
| 131 | Fastener | 135 | Ceiling |
| 140 | Connecting member | 141 | Plate |
| 142 | Nut | 145 | Traction member |
| 147 | Hole | 150 | Air space |
| 155 | Vent opening | 156 | Lateral section |
| 157 | Vertical section | 158 | Bracket |
| 160 | Fan | 161 | Flap |
| 165 | Conduit | 200 | Slide member |
| 205 | Fastener | 210 | Fastener |
| 215 | Skid | 220 | Caster |
| 225 | Stop | 300 | Cabinet or box |
| 600 | Baffle | 400 | Door |
| 402 | Airflow block | 403 | Adhesive |
| 605 | Membrane | 610 | Fastener |
| 800 | Baffle | 805 | Vent |
| 810 | Vent | 815 | Duct |
| 816 | Holes | 900 | Door |
| 905 | Hinge | 910 | Spring |
| 915 | Restraint | 920 | Link |
| 925 | Fastener | 926 | Bracket |
| 930 | Baffle | 935 | Baffle plate |
| 940 | Spring | 945 | Bracket |
| 950 | Foot | 955 | Bulged portion |
| 1000 | Motor | 1005 | Bracket |
| 1010 | Brace | 1015 | Brace |
| 1025 | Shaft | 1030 | Cable drum |
| 1035 | Conduit | 1040 | Speed reducer |
| 1050 | Pulley | 1055 | Pulley |
| 1060 | Cable | 1065 | Bracket |
| 1070 | Support | 1072 | Support |
| 1074 | Bolt | 1075 | Spring |
| 1076 | Nut | 1100 | Cabinet or box |
| 1105 | Arm | 1110 | Pivot |
| 1115 | Counterweight | 1120 | Spring |
| 1125 | Cord | 1200 | Access panel |
| 1202 | Opening | 1205 | Finger |
| 1210 | Clasp | 1215 | Handle |
| 1300 | Bin | 1305 | Partition |
| 1310 | Bracket | 1315 | Drawer pull |
| 2000 | Hinge | 2100 | Spring |
| 2102 | Bumper | 2110 | Stop |
| 2200 | Bracket | 2205 | Shackle |
| 2206 | Pin | 2207 | Bracket |
| 2210 | Duct | 2215 | Duct |
| 2220 | Duct | 2225 | Item for storage |
| 2500 | Bearing | 2505 | Post |
| 2510 | Footing | 2515 | Connector |
| 2518 | Conduit | 2520 | Thermostat or humidistat |
| 2521 | Junction box | 2522 | Conductor |
| 2523 | Conductor | 2524 | Conductor |
| 2525 | Conductor | 2600 | Cubbies |
| 2605 | Bins | 2700 | Duct |
| 2800 | Air treatment unit | 2805 | Duct |
| 3000 | Closure | 3100 | Duct |
| 3105 | Filter | 3109 | Duct |
| 3110 | Louver | 3200 | Duct |
| 3900 | Pivoting bracket | 3905 | Wall |
| 3910 | Cabinet or box rear side | 4100 | Pivot |
| 4102 | Bracket | 4103 | Stop |
| 4105 | Arm | 4110 | Roller |
| 4115 | Spring | 4120 | Bracket |
| 4200 | Channel | 4205 | Poker |
| 4206 | Finger | 4210 | Sliding section |
| 4215 | Hook | 4220 | Pivot |
| 4225 | Spring | 4230 | Restraining member |
| 4230 | Catch | 4232 | Sloped portion |
| 4234 | Finger portion | | |

DESCRIPTION

Figure 1:
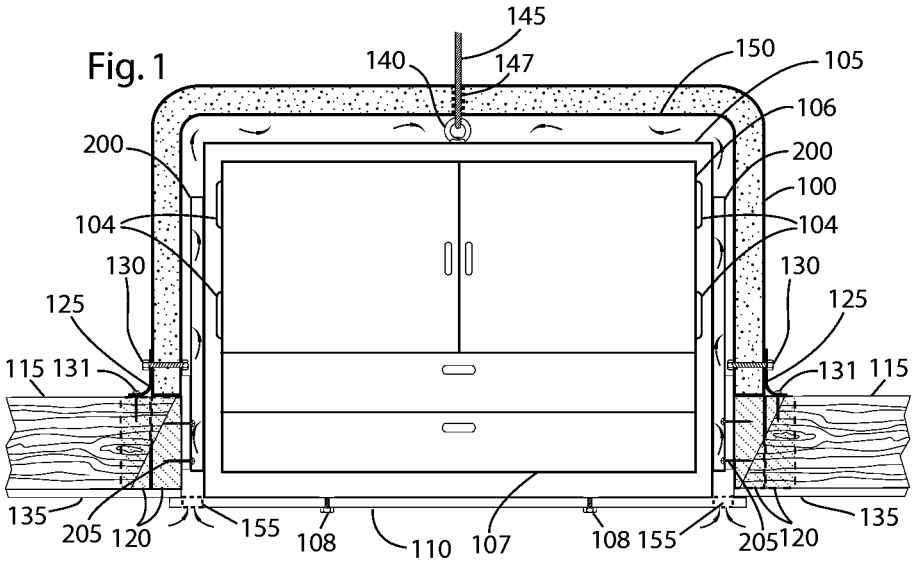
FIG. 1 shows a cut-away view of an embodiment of a closet with a cabinet or box (cabinet) in the stowed position.
Figure 2:
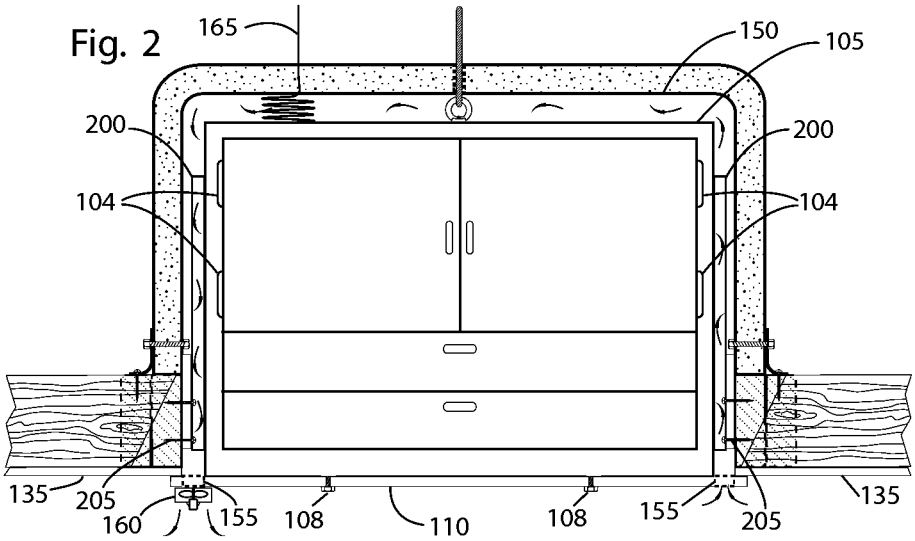
FIG. 2 shows an alternative aspect of the embodiment of FIG. 1 with an optional fan.

FIGS. 1 & 2—Basic System

FIGS. 1 and 2 show front, cut-away views of a basic version of an attic closet system that comprises an outer closet or enclosure (hereafter "closet") 100 that is mounted in an attic. A cabinet or box (hereafter "cabinet") 105 can be lifted from a room below into closet 100. Cabinet 105 has one or more doors 106 that are swingably supported on hinges 104. It has drawers 107 and it rests on and is supported by a panel 110 that includes a plurality of vent openings 155.

Figure 3:
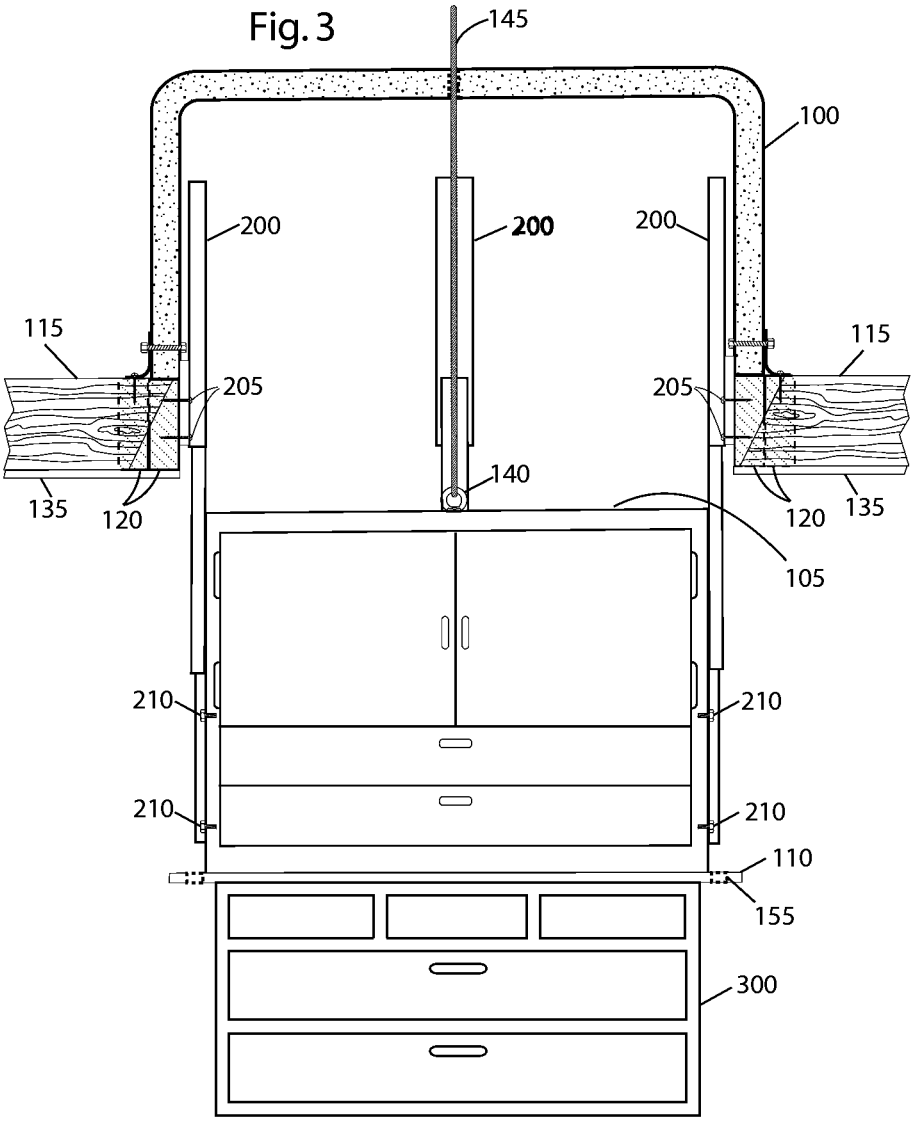
FIG. 3 shows the embodiment of FIG. 1 with a cabinet in a lowered position and the addition of an accessory cabinet.

Closet or enclosure 100 is mounted in the attic by securing it to ceiling truss bottom chords or joists 115 and framing members 120 by angle brackets 125 and fasteners 130 and 131. Closet or enclosure 100 is box-shaped and has five sides and is open on its bottom side. Joists 115 and framing members 120 are covered from below by a ceiling 135 that has an opening congruent with the open bottom side of closet or enclosure 100. A connecting member 140, such as an eye bolt, is secured to the top of cabinet 105. The lower end of a vertical traction member 145, such as a rope, cable, or rod, is attached to connecting member 140. Its upper end (FIGS. 20, 23, 29) is attached to a traction control member 1030, such as a cable drum. The eye bolt, traction member, the traction control member, and a motor 1000 (FIG. 23) for rotating the traction control member thus constitute means for raising and lowering the panel, which is free to be raised and lowered from the ceiling (FIG. 1) to the level below (FIG. 3). Panel 110 is secured to the bottom of cabinet 105 (FIG. 1) by one or more fasteners 108. Fasteners 108 can be permanent or semi-permanent members, such as rivets or screws, or removable fasteners, such as magnets, for easy cleaning of the top surface of panel 110.

As shown, cabinet 105 is stowed within closet or enclosure 100 but can be moved down and out of the closet or for access by a user (not shown) in the room below. In the stowed position of FIG. 1, the upper surface of supporting panel 110 is urged against and slightly overlaps the surface of ceiling 135. As shown, panel 110 is in a horizontal orientation parallel to ceiling 135. When stowed, cabinet 105 is spaced from the interior walls and top of closet or enclosure 100 by an air space 150 which surrounds all of the sidewalls and top of the cabinet 105. I.e., the air space is between the outsides of the cabinet's sidewalls and the top and the inner sides of the walls and top of the closet or enclosure 100.

Cabinet 105 is secured to at least one slide member 200 by one or more fasteners 210 (FIG. 3) that restrains cabinet 105 from moving laterally as it is raised and lowered. Slide member 200 is in turn secured to joist 120 by one or more fasteners 205.

Elevation control of cabinet 105 can also be accomplished with an electrical contact or pressure switch or the like (not shown), mounted, for example, on the top of the cabinet 105 panel and the ceiling area where contact is made when the cabinet 105 is in the stowed position. A control switch can also be located on the exterior cabinet surface positioned to engage when contact is made with a joist or structural member.

Closet 100 is made of a thermally insulating material, such as fiberglass, calcium silicate (sold under the mark Mightylite by Refractory Specialties, Inc., of Sebring, Ohio), fireproof EPE (expanded polyethylene foam) sheet with aluminum film siding, magnesium oxide cementitious foam (sold under the mark Air Krete by Air Krete, Inc., of Weedsport, N.Y.), polystyrene, or other insulating material. Closet 100 optionally has exterior metal, fiberglass or plastic composite walls for structural strength, if required to support a particular insulating material. Closet 100 can be made of any other suitable materials, including wood and all-metal construction, preferably two-walled construction, with a middle layer of insulation. Cabinet 105 is made of wood, metal, fiberglass, plastic, paper, composite or other material and is of simple construction.

In one embodiment closet 100 had exterior dimensions of 1.14 m in length, 0.85 m in width, and 0.77 m in gross height, measured from the bottom surface of ceiling 135, with the height reduced by the height of the joists 115 or truss bottom chords, not shown, and the thickness of ceiling 135. In this case the reduction is 17.8 cm, indicating a net closet height of about 0.59 m measured from the top of the joists and structural members to which it is mounted.

In the same embodiment cabinet 105 had an exterior length of 0.95 m, a width of 0.69 m, and a height of 0.66 m. The widths of closet 100 and cabinet 105 will generally be suited to the spacings of the ceiling joists or truss bottom chords in existing or new constructions. These are typically on 0.41 m and 0.61 m centers, respectively. To create a wider ceiling opening, ceiling joists 115 are typically cut and cross supported with structural members or headers 120. Other support members include a bottom chord, a framing member, a timber structured ceiling, and a concrete ceiling. Air space 150 between the sides of cabinet 105 and closet 100 is 4.32 cm and the air space above the cabinet was 5.33 cm. The panel was 1.08 m in length, 0.82 m in width, and 1.78 cm in thickness. Any or all of these exemplary dimensions can be modified or adapted to suit the user's requirements and the structural specifications of the building into which the unit is to installed. With adequate roof clearance, closet 100 and cabinet 105 can be more than doubled in height to accommodate storage of longer hanging garments or other large items. Cabinet 105 may include drawers, bins, trays, shoe cubbies, clothes hangers, book shelves and other storage accommodations. Cabinet 105 is fabricated of metal, wood, plywood, MDF (medium-density fiberboard), hardboard, fiberglass, plastic, composite, carbon fiber, hollow core material, honeycomb material, corrugated plastic, paper, and a combination of any materials from this group. Cabinet 105, closet 100, or both, is optionally encased in a strong wall material such as steel or another substance. A key-activated control switch is optionally added to provide security protection.

Operation

First Embodiment

FIGS. 1 and 2—Passive Circulation of Air

When cabinet 105 is stowed, vent openings 155 in panel 110 permit air to circulate and mix into air space 150 by convection between the volume or room beneath ceiling 135 and air space 150. The result of this mixing is a reduction of the difference in temperature between cabinet 105 and the living space below 100. I.e., in winter, warm air from the room below ceiling 135 rises and enters air space 150, increasing the temperature around and hence within cabinet 105. In summer, cooler air from the room below ceiling 135 enters air space 150 and decreases the temperature of cabinet 105. Thus cabinet 105 and its contents are protected from temperature swings that occur in the attic space outside closet 100. Panel 110 completes the ceiling and covers the ceiling opening through which the cabinet is moved. It can be finished to match the ceiling.

Active Circulation of Air

FIG. 2 shows an alternative aspect of the embodiment of FIG. 1 in which a fan 160 urges air to pass through one or more of vent openings 155, thereby increasing the flow of air between the room below ceiling 135 and airspace 150. Fan 160 can urge air out of or into airspace 150 via vent openings 155. An source of energy (not shown) is connected to fan 160 via a flexible conduit or cable 165. Conduit 165 rests on the top of cabinet 105 while cabinet 105 is stowed and snakes down (not shown) inside or outside of cabinet 105 to fan 160. Conduit 165 can be self-coiling. A switch for energizing fan 160 can be mounted in the room below and wired to energize line 165, or it can be a remote RF-transmitting switch that controls an RF-controllable receiving switch in line 165. Fan 160 can also be thermostatically operated so that it is energized at predetermined high and/or low temperatures. Fan 160 is shown positioned adjacent and below vent 155 but it can also be positioned adjacent and above vent 155. within vent 155, or within the closet.

Description & Operation

FIG. 3—Accessory Cabinet Below

In many homes, there is limited clear height in the attic so that the attic lacks insufficient room for stowing a tall storage cabinet 105. FIG. 3 shows an alternative embodiment that adds an accessory cabinet 300 beneath panel 110. Accessory cabinet 300 is secured to the underside of panel 110, which in turn is secured to the bottom of cabinet 105. Cabinet 300, panel 110, and cabinet 105 are shown in a lowered position, suspended from cable 145 via connecting member 140. When cabinet 105 is raised into the attic and stowed, cabinet 300 rises with it to move up adjacent the ceiling to remain accessible in the room below at all times. Upon lowering cabinet 105, cabinet 300 rests on the floor (not shown) of the room below to become even more accessible to a user. As shown, in the lowered position of FIG. 3, panel 110 remains in the horizontal orientation parallel to ceiling 135 and the orientation of cabinet 105 retains the upright orientation in the raised and lowered positions of the panel.

Description & Operation

FIGS. 4 to 7—Air Blocks

FIGS. 4 to 7 show another alternative aspect where air blocks are used to provide a measure of selective control of the airflow around cabinet 105 when stowed in closet 100.

Figure 4:
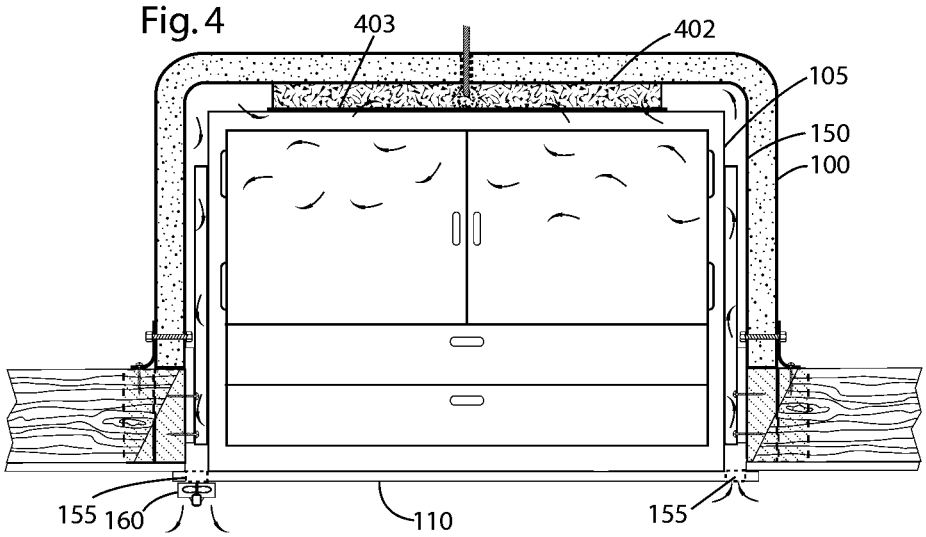
FIG. 4 shows the embodiment of FIG. 1 with the addition of a top air space block.

FIG. 4 shows a side view of cabinet 105 stowed in closet 100. In a first aspect, air is prevented from flowing over a portion of the top of cabinet 105, but is permitted to flow over the sides of cabinet 105. In this case, the top of cabinet 105 does not reach the inner top surface of closet 100 when cabinet 105 is fully stowed. A section of closed-cell foam or other material forms an airflow block 402 that is interposed between the top of cabinet 105 and the inner top surface of closet 100. Block 402 is secured either to the top of cabinet 105 or to the inner top surface of closet 100 using an adhesive. Block 402 is either sized to match the width and depth of cabinet 105 in order to fully cover the top or a smaller block 402 as shown can be used. Alternatively, block 402 is sized to match the area of the inner top surface of closet 100 or a portion thereof. In either case, the thickness of block 402 is equal to the height of the gap between the top of cabinet 105 and the inner top surface of closet 100 when cabinet 105 is stowed. In another aspect, block 402 is compressible so that its thickness can be greater than the gap between the top surfaces of cabinet 105 and closet 100. Thus block 402 will be compressed for a snug fit between the top surfaces of cabinet 105 and closet 100 when cabinet 105 is stowed. Accordingly block 402 provides a means to selectively regulate the effects of airflow over the top of a cabinet 105 when stowed as well as to permit the use of a lower capacity fan. This makes cabinet 105 less subject to the thermal effects of airflow by providing a means for modulation. Utilizing air blocks to reduce the required fan capacity can also mitigate air turbulence and sound emissions, especially advantageous in a bedroom application.

Figure 5:
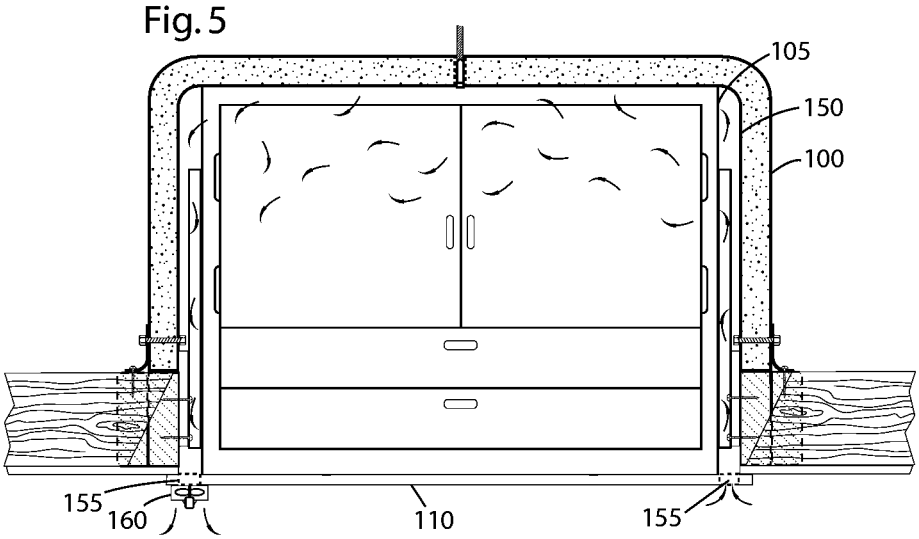
FIG. 5 shows the embodiment of FIG. 1 with the top of a cabinet seated against the underside of the top of a closet.

FIG. 5 shows a side view of another aspect of the present embodiment in which the height of cabinet 105 permits the top of cabinet 105 to contact or very nearly contact the top inner surface of closet 100 when cabinet 105 is fully stowed. Similar in function to the arrangement of FIG. 4, block 402 provides another means for selectively regulating the effects of airflow over the top of a cabinet 105 when stowed. However the arrangement of FIG. 5 requires no additional components to accomplish this same function and is less costly to implement.

In both aspects, air passing through vents 155 is blocked or partially blocked from passing over the top of cabinet 105, while it is urged to pass over the sides. Fan 160 is optional in these aspects.

Figure 6:
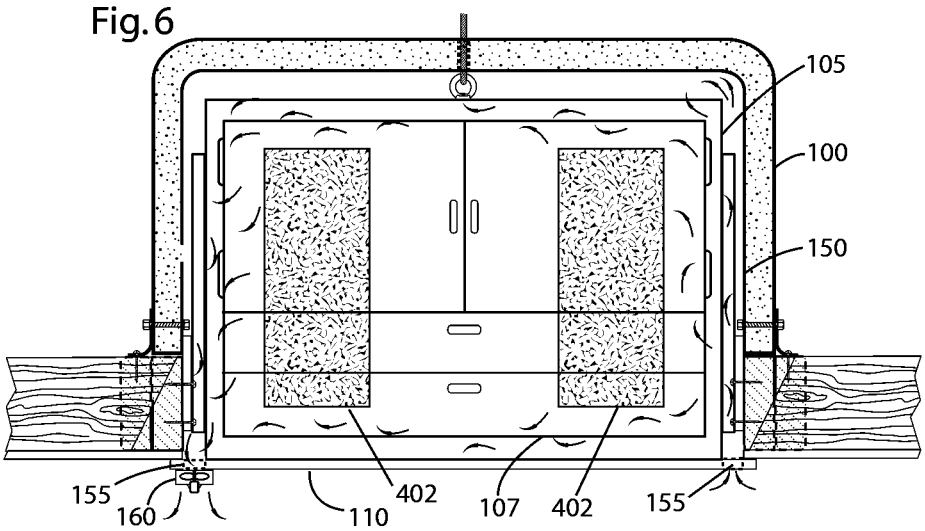
FIG. 6 shows the embodiment of FIG. 1 with air space block material adhered to a closet sidewall.
Figure 7:
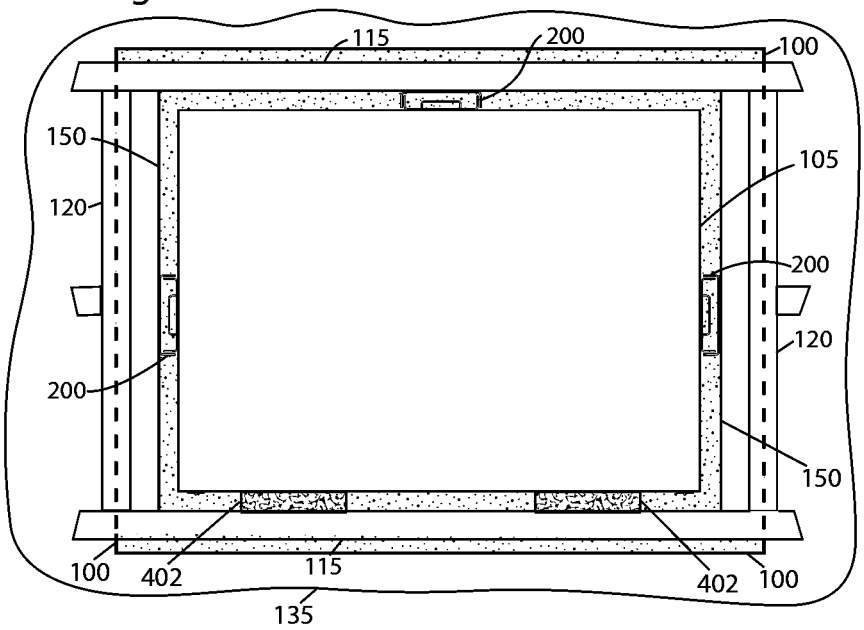
FIG. 7 shows a bottom view of the embodiment of FIG. 6.

FIGS. 6 and 7 show side and bottom views respectively of an alternative aspect in which closed-cell foam or other material forms an airflow block 402 that is adhesively secured to the inner sidewall of closet 100, facing the front, i.e., door or drawer-opening side, of cabinet 105. In this aspect, block 402 reduces, depending on thickness, or prevents air from circulating laterally across the front side of cabinet 105. Similar in purpose to the arrangements of FIGS. 4 and 5, FIGS. 6 and 7 also show how block 402 can serve to secure cabinet doors and drawers in a closed position when cabinet 105 in elevated. Fan 160 is optional in these various aspects of the present embodiment.

Description & Operation

Figure 8:
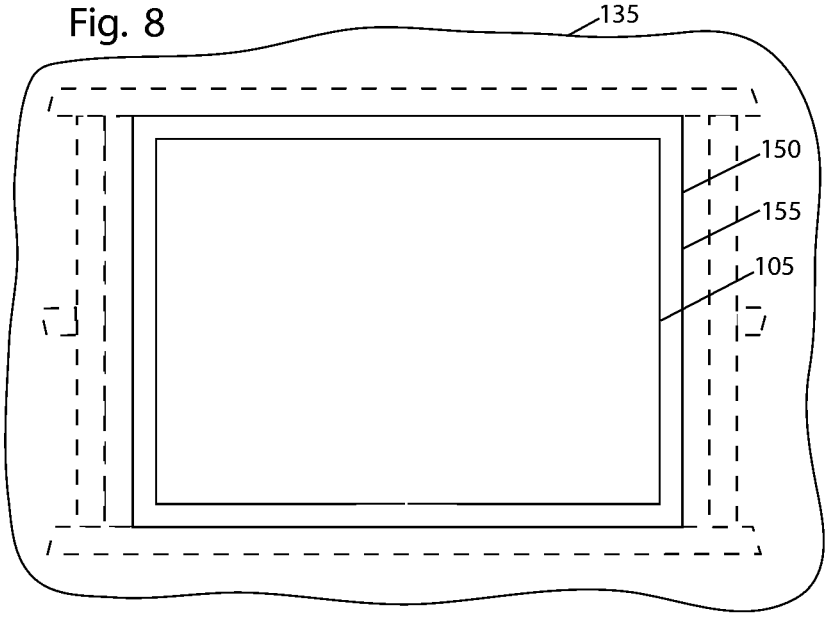
FIGS. 8 and 9 show alternative aspects of the embodiment of FIG. 1 without a panel.
Figure 9:
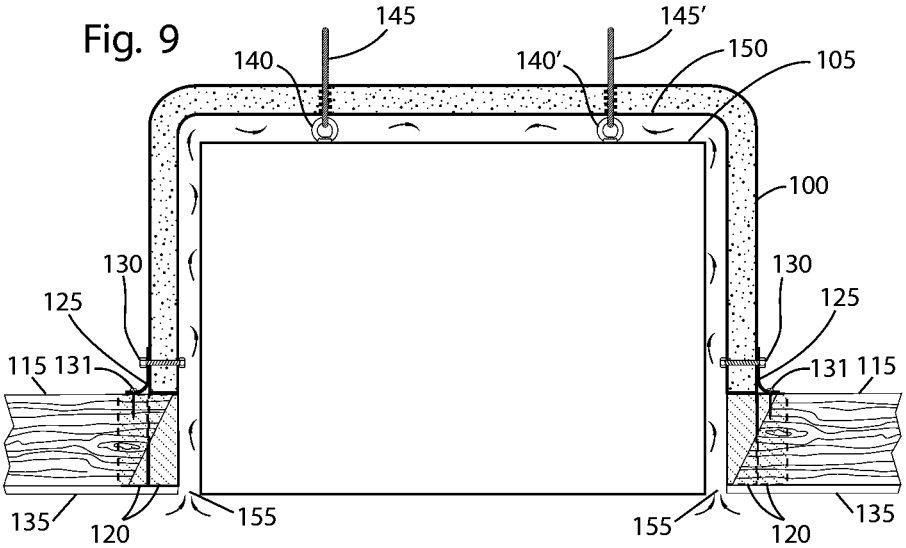

FIGS. 8 & 9—No Panel

FIGS. 8 and 9 are bottom and front views of another embodiment showing cabinet 105 in closet 100 without sliding members 200 or panel 110. Cabinet 105 is manually guided to remain within air space 150 as it moves up and down past ceiling 135. This embodiment has a vent opening around the full perimeter of the cabinet bottom. In one aspect, an additional traction cable 145' and connecting member 140' help constrain the path of cabinet 105 as it moves into and out of closet 100. Note that the bottom surface of cabinet 105 is flush with ceiling 135.

Description & Operation

FIG. 10—Guides Without Panel

FIG. 10 shows a bottom view of another embodiment of cabinet 105 in attic closet without the use of any panel 110 but with sliding members 200 (as in FIG. 3) shown attached to joist 115 and framing members 120. Air space 150 surrounds cabinet 105.

Description

Panels—FIGS. 11A to 11H

FIGS. 11A to 11C show side views of various types of arrangements that can be used for panel 110 (FIG. 1). FIG. 11A shows a panel 110' sized to cover only the bottom of the cabinet (not shown), leaving a continuous rectangular vent opening 155 underlying the space all around the outer edge of the cabinet. FIG. 11B shows a relatively thick panel 110" made of open-cell foam, OSB (oriented strand board), MDF medium density fiberboard, particleboard, chipboard, or other porous or semi porous material. FIG. 11C shows a relatively thin panel 110''' made of non-insulating materials, permitting convective thermal transfer between the air space and living space below. These materials comprise a great variety of wood, metal, and plastic products.

FIGS. 11D to 11H show plan views of coverings for vent opening 155 that provide free airflow and have various decorative appearances, such as a screen with diagonal crisscrossing wires, a mosaic with squares of alternating vertical and horizontal parallel lines, simple parallel wires, linked undulating members, and a stippled array with decorative apertures, respectively. These sheet materials include woven screening, woven fabrics, porous and non-porous materials, and various plastics, which provide thermal transfer between the air space and living space below.

Description

Alternative Panel Constructions—FIGS. 12 to 15

Figure 12:
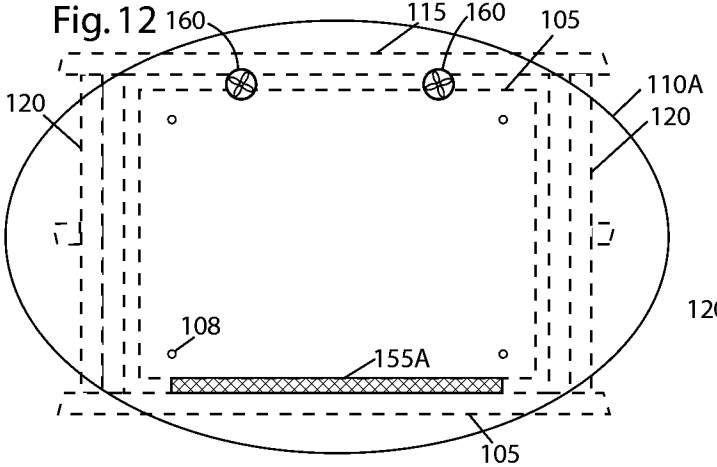

FIGS. 12 to 15 show alternative configurations and constructions of panel 110. FIG. 12 shows a bottom view of a decorative oval panel 110A. Panel 110A is sized to cover the space between cabinet 105 and joists 115 and framing members 120.

Figure 13:
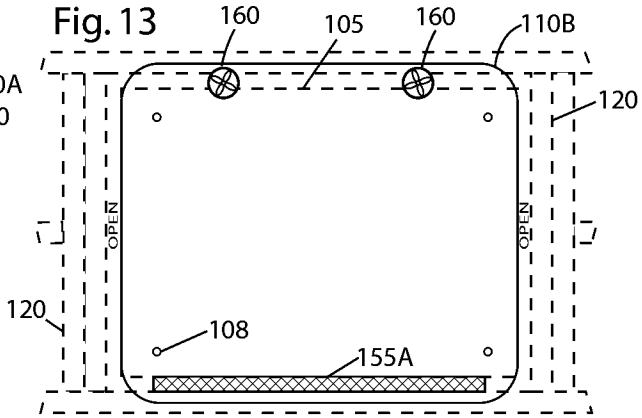
FIGS. 12 to 15 show various alternative panels.

FIG. 13 shows a bottom view of a panel 110B that is sized and configured to leave open space between the lateral edges of panel 110B and the inner, facing surfaces of joists 120. This permits air to flow freely into the space surrounding cabinet 105. Optional fans 160 increase this airflow, when energized.

Figure 14:
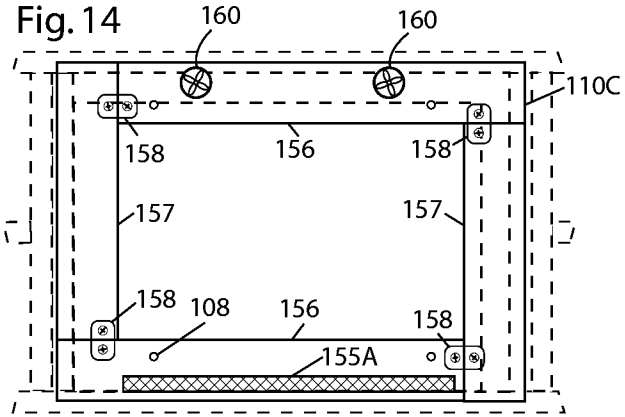

FIG. 14 shows a bottom view of a cost-reducing, multi-piece panel 110C that is assembled on a job site. A pair lateral sections 156 and vertical sections 157 are arranged in a rectangle and are joined at their corner joints by a plurality of brackets 158 to form a rigid panel.

Figure 15:
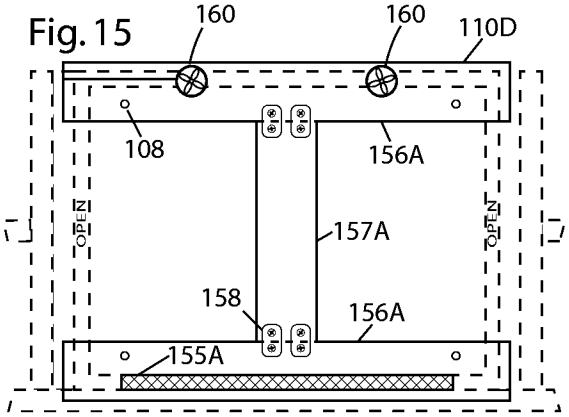

FIG. 15 shows a bottom view of an open end panel 110D for increased airflow and cost reduction. A pair of lateral sections 156A are rigidly secured to a cross-piece 157A by a plurality of brackets 158.

In these various aspects, one or more fasteners 108 secure panels 110 to the cabinet 105. Vents 155A allow airflow through panels 110A to 110D. Optional fans 160 located in panels 110 circulate air into and out of the region above panel 110 when energized.

Description

Figure 16:
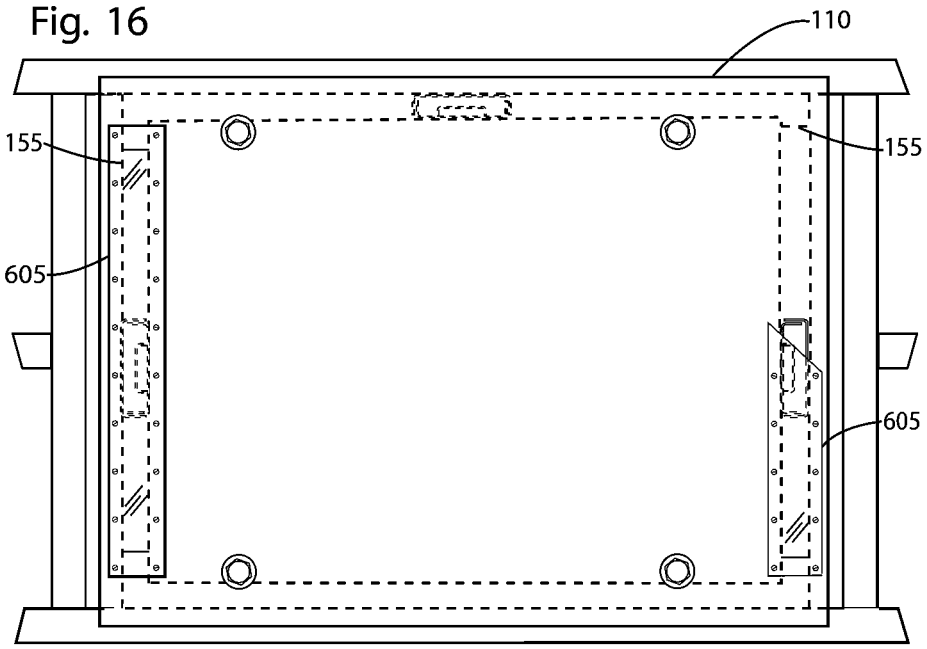
FIGS. 16 and 17 show an alternative panel for blocking airflow while allowing heat conduction.
Figure 17:
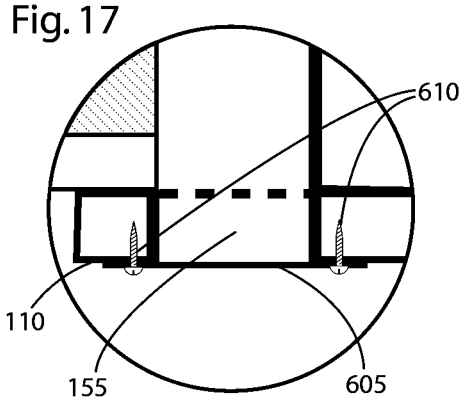

Alternative Panel for Blocking Airflow—FIGS. 16 and 17

FIG. 16 shows a bottom view of panel 110 in an alternative aspect that allows heat transfer between a living space below and an attic above while blocking airflow between the two. Rectangular vent opening 155 is covered with an impermeable membrane 605 made of a fire-retardant material such as fire-retardant polyethylene or other plastic, film, tape or even a thin metal or other membrane. All vent openings are covered by the membrane. Membrane 605 allows convective heat transfer between space above and space below panel when cabinet 105 is in the elevated position. This allows some thermal transfer between the two spaces while blocking movement of insects or dust between the two spaces.

FIG. 17 is a cross-sectional view of vent opening 155 in panel 110 that is covered by-membrane 605 that is secured to panel 110 by fasteners 610. Heat is conducted through membrane 605 and convective forces in the air on either side of membrane 605 tend to equalize the temperatures between the attic above and the living space below while preventing dust, moths, and the like from passing therethrough. Membrane 605 can be transparent, opaque, translucent, or colored, as desired.

Description & Operation

Figure 18:
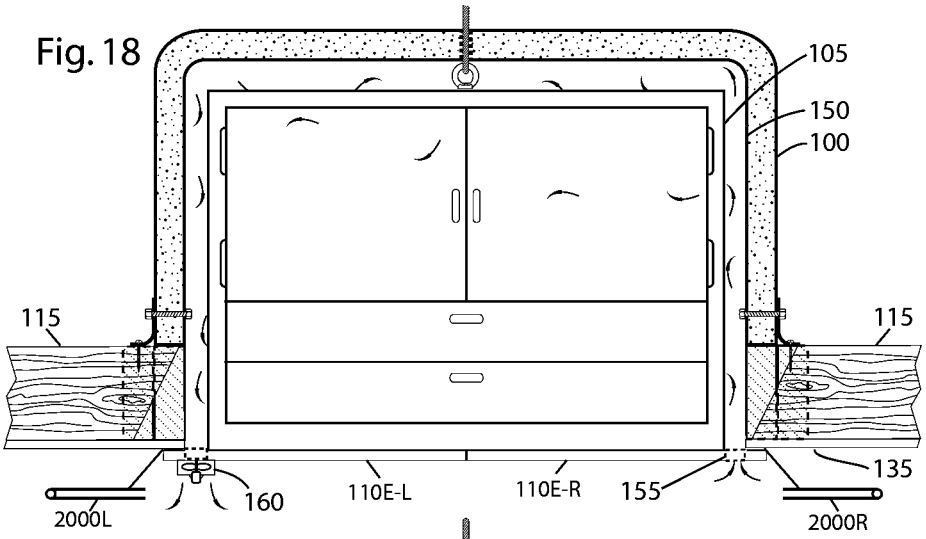
FIGS. 18 and 19 show a two-part panel that serves as a cabinet stabilizer.
Figure 19:
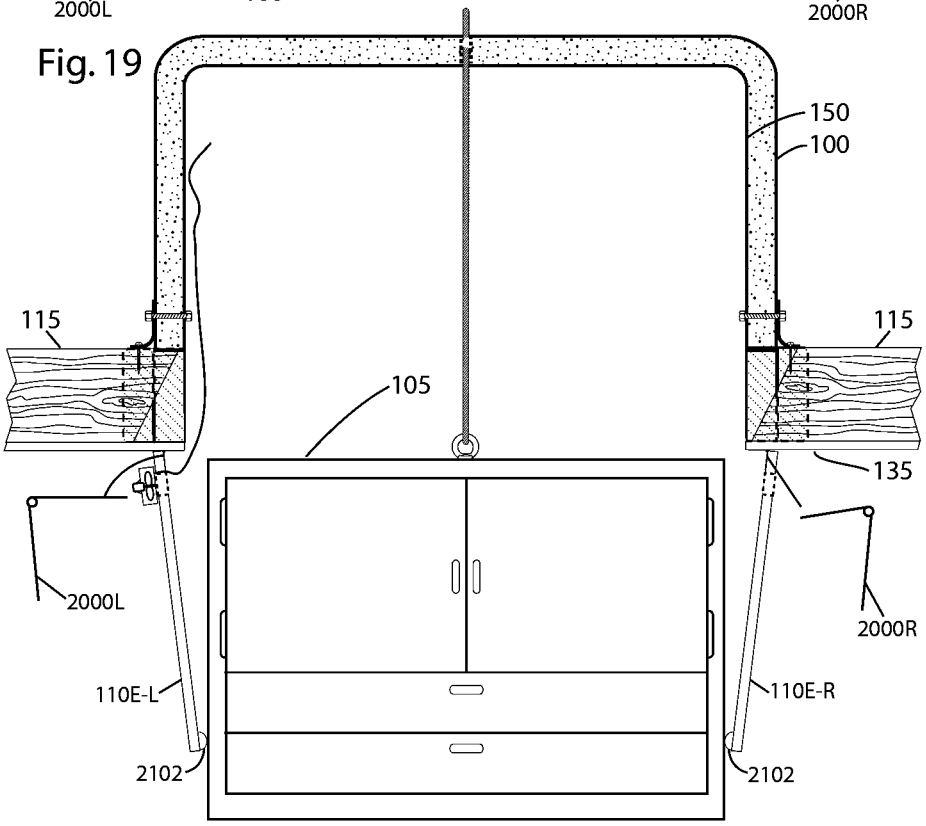

Two-Part Rotatable Panel Sections—FIGS. 18 and 19

FIGS. 18 and 19 show side cut-away views of a modification of the embodiment of FIG. 1 where the panel has two parts or sections that are rotatable for enabling removal of the cabinet. Cabinet 105 is shown in stowed and lowered positions, respectively. In this aspect, a panel 110E comprises two sections 110E-L (left) and 110E-R (right). A hinge 2000L pivots the left-hand end of section 110E-L on ceiling 135 at the left-hand end of closet 100 and a spring in this hinge (not shown) urges section 100E-L horizontally up against the ceiling as shown. Similarly, a spring loaded hinge 2000R urges the right-hand end of section 110E-R up against ceiling 135 on the right-hand end of closet 100.

FIG. 18 shows cabinet 105 fully stowed. Springs 2100-L and 2100-R urge and hold panel sections 110E-L and 110E-R into their uppermost (horizontal) positions. When cabinet 105 is lowered, as shown in FIG. 19, the bottom of cabinet 105 cams both sections 110E-L and 110E-R to rotate on hinges 2000L and 2000R, respectively, to substantially vertical positions as shown, thereby opening panel 110E and permitting cabinet 105 to be lowered for access. A pair of bumpers or rollers 2102 bear against cabinet 105 for smooth operation. When cabinet 105 is raised, springs 2000L and 2000R respectively urge panel sections 110E-L and 110E-R to close.

Description & Operation

FIGS. 20A to 20C—Panel

FIG. 20A shows a panel which can support and elevate a storage item such as a cabinet, a box or boxes, or any other article, such as an old computer, air conditioner, etc. FIG. 20B shows a detachable cable means for the panel and FIG. 20C illustrates a fire link mounted to the panel, which elevates to the bottom of a closet.

FIG. 20A shows a side cut-away view of several aspects of a fourth alternative embodiment. An optional accessory cabinet 300 is secured to the underside of a panel 110. In one aspect, an item 2225 for storage, such as a cabinet, box, container, or object, rests atop panel 110.

In another aspect, one or more cables 145 are permanently fixed to panel 110 by one or more attachment brackets 2200, as shown on the left-hand side of panel 110. In still another aspect panel 110 is detachable from cables 145. In this case, brackets 2200 are replaced by shackles 2205 (FIG. 20B) and cable 145 is secured to a shackle 2205. A shackle bracket 2207 is secured to panel 110, and shackle 2205 and shackle bracket 2207 are joined by a shackle pin 2206. Thus panel 110 is optionally detachable from cables 145 and interchangeable with other panels 110.

In another aspect, a duct 2210 (FIG. 21) extends upward from a vent 155 to a point near the top inner surface of closet 100. When energized, a fan 160 below the duct urges air from the upper portion of closet 100 to enter duct 2210 and then be expelled downward, exiting beneath panel 110. In this case, air enters closet 100 from vent 155 near the left-hand end of panel 110. Fan 160 may also be positioned within the duct or above the duct.

In still another aspect, a pair of ducts 2215 and 2220 (FIG. 20A) each pass through ceiling 135 and the walls of closet 100, thereby connecting a region beneath ceiling 135 and the interior of closet 100. A fan 160A urges air to flow from the region beneath ceiling 135, through duct 2220, closet 100, and duct 2215, and back into the region beneath ceiling 135.

A conductor 2522 is connected to an energizing source (not shown) such as a power main. Conductor 2522 is connected to a sensor that is either a thermostat or humidistat 2520 and to fans 160 and 160A via conductors 2523 and 2524, respectively. Fans 160 and 160A are connected in parallel and thermostat or humidistat 2522 is connected in series with fans 160 and 160A and conductor 2522. The junctions of these connections are contained within a fan control junction box 2521. A pair of electrical connectors 2515 and 2515' are interposed between conductor 2523 and fan 160, and between conductor 2524 and fan 160A. The circuit within thermostat or humidistat 2520 is normally open and fans 160 are not energized. When the temperature or humidity (depending on whether device 2520 is a thermostat or humidistat) exceeds a predetermined level, the circuit within thermostat or humidistat 2520 is closed, thereby activating fans 160 and 160A by connecting them to an energizing source. Connectors 2515 and 2515' are disconnected when it is desired to service or replace either fan 160 or 160A.

In yet another aspect, in the event of a fire it is important to prevent flames from entering an attic from the living space below, and vice versa. FIG. 20C is a side view of a fire damper door 900 that blocks vent openings in the event of a fire. Door 900 is made of sheet metal or other fireproof or fire retardant material and is mounted on a hinge 905 and is urged to close over vent openings 155 by a spring 910. A restraint 915 is secured to a fire link 920 which in turn is secured to a bracket 926 by a fastener 925 which is secured to a panel 110. In the absence of a fire, restraint 915 and link 920 hold door 900 in a normally open position, allowing free flow of air through vent openings 155. In the event of a fire, link 920 divides into two segments, releasing restraint 915, permitting spring 910 to urge door 900 to close, thereby blocking opening 155. Link 920 includes thermal, thermal electric, resettable, and other types of releasing devices used to prevent the spread of fire. These are sold by SR Products, LLC, Globe Technologies Corporation, PHL Links, LLC, and others.

Description & Operation

Panels That Do Not Seal Ceiling Opening—FIGS. 21 and 22

FIG. 21 shows a side view of a panel that does not seal a ceiling opening according to another aspect. One or more stops 2110 of wood or plastic are located at the outer periphery of panel 110 in a position where they will prevent panel 110 from fully closing against ceiling 135. Stops 2110 are spaced apart at the periphery of panel 110 so that air can flow between them when panel 110 is fully raised against ceiling 135. Stops 2110 can be secured to panel 110 or to ceiling 135. Four stops were preferably used and each was 1.25 cm high by 1.6 cm wide and 6 cm long, but these parameters can be varied. A fan 160, connector 2515, conductors 2522, 2523, and 2525, and thermostat or humidistat 2520 are connected within a junction box 2522, as described.

FIG. 22 shows a bottom view of another panel that does not seal the ceiling opening. The length and width of panel 110 are smaller than the length and width of the interior wall of closet 100 by a predetermined amount. An open gap is thus formed between the periphery of panel 110 and the interior wall of closet 100, thereby allowing air to flow between the region beneath panel 110 and the interior of closet 100.

Description & Operation

Exchangeable Optional Cabinet—FIGS. 23 & 24

FIG. 23 shows a side cut-away view of an alternative cabinet 105A that is optionally secured to a panel 110F by one or more fasteners 108 (FIG. 23). Panel 110F includes vents 155 that are described above; it further includes a larger vent 155A that traverses panel 110F adjacent the front of cabinet 105A. Panel 110F is secured to cable 145 with shackles 2205 to permit the panel to be replaced easily.

As shown in detail in our above co-pending '228 application, a shaft 1025 is rotatably connected to a motor 1000 at a first end and a bearing 2500 at the opposite end. Motor 1000 and bearing 2500 are supported as shown by a pair of post assemblies 2505. Post assemblies 2505 are supported by footings 2510 that rest on joists 115. A pair of cable drums 1030 is rotatably secured to shaft 1025. Drums 1030 hold cables 145 that are sufficiently long to lower cabinet 105A and panel 110F to a desired height in the region below ceiling 135. Motor 1000 is reversible so that when it is activated and urged to rotate in a first direction, shaft 1025 and drums 1030 act to raise panel 110F and cabinet 105A, and to lower them when motor 1000 is rotated in the opposite direction.

Cables 145 are secured to panel 110F, as described above in connection with FIG. 22. When the user desires to replace cabinet 105A or panel 110F, panel 110F is lowered, shackles 2205 are released from brackets 2207, thereby releasing cables 145 from panel 110F. The process is reversed when another panel is to be installed.

FIG. 24 shows a side view of panel 110F with cabinet 105A removed and cables 145 disconnected. Fan 160 is secured to panel 110F. When panel 110F is replaced, fan 160 is disconnected. A two-part electrical connector 2515A, 2515B is used for this purpose. This connector is inserted into electrical conductor 2523 that supplies activating energy to fan 160. If a new panel and fan are to be installed, connector portion 2515A (not shown) is connected to the existing connector portion 2515B so that fan 160 can be energized. An electrical conductor 2518 is connected to an external electrical source (not shown) and to a thermostat or humidistat 2520 in series with fan 160. Thermostat or humidistat 2520 is an electrical component that allows electrical current to pass from conduit 2518 to conduit 2517 when the temperature sensed by thermostat or humidistat 2520 exceeds a predetermined threshold, thereby activating fan 160. When the temperature sensed by thermostat or humidistat 2520 is below a predetermined threshold, thermostat or humidistat 2520 opens the electrical circuit between conduit 2518 and fan 160, thereby deactivating fan 160.

Description & Operation

Addl. Features in Exchangeable Cabinet—FIG. 25

FIG. 25 is a cut-away side view of one aspect of a sixth alternative embodiment. In this embodiment cabinet 105 includes cubbies 2600, i.e., enclosed shelves, bins or tubs 2605, and drawers 107. A plurality of cables 145 are secured to the top surface of cabinet 105. Four cables 145 are shown in FIG. 25 and are raised and lowered in unison so that cabinet 105 remains in a vertical position without tipping.

In one aspect, no panel is used. Since cabinet 105 is smaller than the interior of closet 100, air is able to freely flow around the sides and top of cabinet 105 when it is stowed within closet 100. An optional fan 160 and thermostat 2500, as described above, provide forced airflow within closet 100. In another aspect, airflow blocks 402 are included to urge air to flow in a predetermined pattern around cabinet 105, in a manner similar to that discussed above in connection with FIGS. 4 and 6. Optional air bocks 402 are placed between an outer surface of cabinet 105 and inner surface of closet 100, allowing control and modulation of air flow therebetween.

Fan 160 and thermostat or humidistat 2520 are optional in this aspect. Their function is described in detail above in connection with FIGS. 23 and 24.

Description & Operation

Integrated Closet and Cabinet—FIGS. 26 to 28

FIGS. 26 to 28 show an integrated cabinet 105' positioned inside a closet 100' both of which are attached to panel 110 with fasteners 108 and 108'. There is an air space between all the sides and the top of cabinet 105' and the adjacent closet 100' inside walls and inner top surface. The closet doors 400L and 400R are adjacent the cabinet doors 106 with an air space therebetween. The bottom of the cabinet 105' and the bottom of the closet 100' are substantially coplanar and the cabinet 105', closet 100' and panel 110 descend and elevate together as an integrated unit. An optional fan or air treatment unit circulates air through the air space. All ok FIG. 26 shows one aspect of an alternative embodiment in which closet 100', shown in its stowed position, contains a cabinet 105'. An optional accessory cabinet 300 is affixed to the bottom of panel 110 and extends into the room below ceiling 135 when panel 110 is fully raised. An optional fan 160 is provided on panel 110 to draw air from the area below through vent 155, circulate the air around cabinet 105' and discharge the air back into the area below through vent 155. all ok Closet 100' is connected to cable 145 by a connecting member 140. A plate 141 and nut 142 provide secure attachment of connecting member 140 to closet 100'. Closet 100' is secured to a plurality of vertical sliding members 200. Sliding members 200, in turn, are secured to brackets 125 by a plurality of fasteners 130. Brackets 125 are secured to joists 115 and framing members 120 by a plurality of fasteners 131, as with the first embodiment.

Closet 100' includes a pair of doors 400L and 400R, shown by a solid line in FIG. 26, attached to closet 100' with hinges 2000. Doors are closed when closet 100' is stowed, but can be opened when closet 100' is in its lowered position. Doors 400 are made of the same insulating material as the rest of closet 100'. Cabinet 105', shown by a dashed outer line in FIG. 26, includes a second set of hinged doors 106, shown by a dashed inner line. When closet doors 400 and cabinet doors 106 (FIG. 27) are open, a user (not shown) has access to cabinet 105' and its contents.

FIG. 27 shows a fan 160' that is located atop closet 100' and connected to a duct 2700. When fan 160' is energized, duct 2700 urges air to enter vents 155, pass through closet 100', and exit via duct 2700. Duct 2700 conducts air into the space above closet 100', back into the area below or out-of-doors.

In highly insulated homes lacking forced air heating systems, common in European countries, excessive humidity can cause hazardous mold buildup. An air treatment unit such as an air conditioner, heater, heat pump, dehumidifier, or HVAC (heating, ventilating and air conditioning) unit connected to a storage system provides treated air to both control the temperature and/or humidity of the air within a closet and also can supply treated air to a living space below. Properly sized and located, such an arrangement can heat, cool, ventilate and/or dehumidify the air in multiple rooms or areas. Such an arrangement can reduce or eliminate the frequent need to air out a living space through the opening of windows and doors with the associated inconvenience and heat loss.

FIG. 28 shows a third aspect of the present embodiment. Here an air treatment unit 2800 consisting of a fan 160', an air conditioner, a heat recovery ventilator, an energy recover ventilator, a heater, a heat pump, a dehumidifier, an evaporative cooler and a heating, ventilating and air conditioning unit 2800, connected to said closet or enclosure, is connected to the top end of a duct 2805 whose bottom end is connected to closet 100'. Duct 2805 conducts air from unit 2800 into air space 150 within closet 100 where the air circulates around cabinet 105' prior to leaving closet 100' via duct 2700. Discharged air can be returned to the air treatment unit 2800, ducted to the area below via vents 155 or ducted to outside.

Ducts 2700 and 2805 are flexible in order to lengthen when closet 100' is lowered and then to retract when closet 100' is raised. Similar to the embodiment of FIGS. 8 and 9, closet 100' can also operate without sliding members 200 and is manually guided into attic space as it moves up and down past ceiling 135.

Description & Operation

Dual Chamber Closet w/Ducted Fan—FIGS. 29 & 30

FIG. 29 shows a cut-away end view of another embodiment using a two-chamber closet 100" having a first chamber 101A and a second chamber 101B. Chamber 101A contains a cabinet 105 and has slides 200 that guide cabinet 105 as cabinet 105 is raised and lowered. An optional support 1072 joins chambers 101A and 101B with joist 115 and framing member 120 for added support. A support 1070 forms a wall between chambers 101A and 101B and also supports a motor 1000, a speed reducer 1040, and a cable drum 1030. A cable 1060 extends from drum 1030, around an idler 1061, and is secured to a bolt 1074. Bolt 1074 is attached to a bracket 1065 that in turn is attached to panel 110. A spring 1075 between a nut 1076 at the end of bolt 1074 and bracket 1064 provides cushioning as cabinet 105 is raised and lowered, and also permits motor 1000 and its associated drive train to urge panel 110 firmly into contact with ceiling 135. Cable drum 1030 holds sufficient cable 1060 to permit lowering cabinet 105 to a predetermined distance below ceiling 135.

A fan 160 is installed in support 1070. When energized, fan 160 draws air into vent 155-L, through chamber 101A, optionally through duct 815, then through chamber 101B, and finally out of chamber 101B via a second vent 155-R.

A fire door 900, similar to those shown above, is shown in vent 155-L. FIG. 30 shows an alternative fire door 900' in vent 155-R. Instead of a flapper door and a spring, as in the case of fire door 900, the closure 3000 of fire door 900' is a piece of spring steel that is sized to fit over vent 155-R. With no restraint, closure 3000 rests over vent 155-R, thereby closing it and preventing fire from reaching chamber 101B. A first end of a link 920 is first secured to support 1070. Then, in order to permit air to pass from chamber 101B to the space beneath panel 110, closure 3000 is springably bent and joined to a second end of link 920 as shown. In the case of fire, link 920 melts and closure 3000 assumes its original shape, blocking vent 155-R.

Description & Operation

Air Treatment Units Attached To Closet—FIGS. 31 to 33B

FIGS. 31 to 33B show several aspects of a ninth alternative embodiment. Treated air, i.e., air that has been heated, cooled, humidified, or dehumidified, or a combination thereof, is circulated through closet 100 and optionally through the volume below ceiling 135.

Figure 31:
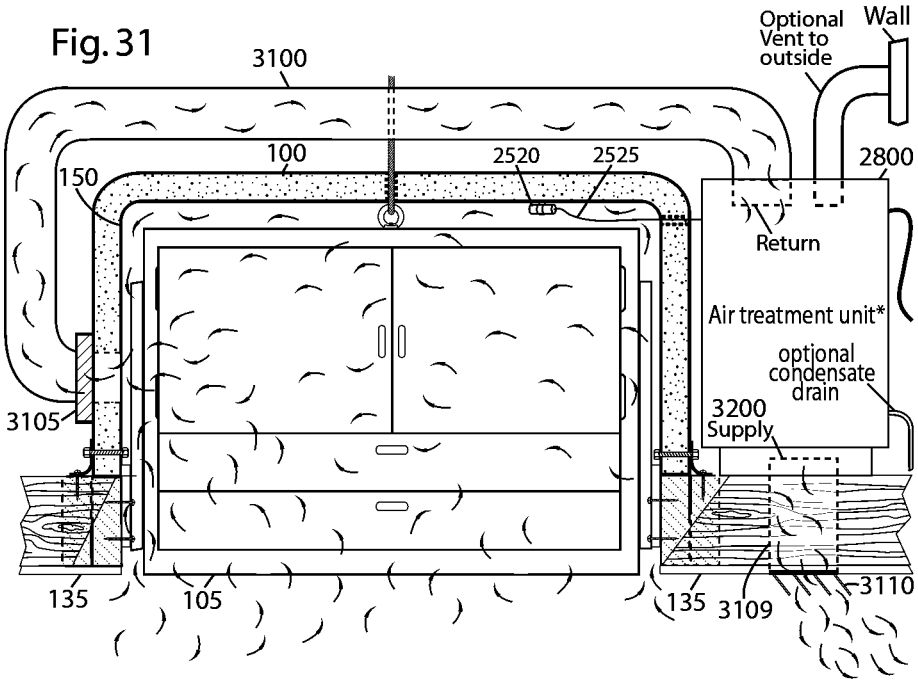

FIG. 31 shows a cut-away side view of a closet 100 with a first ducting arrangement. There is no panel beneath closet 100 so that air from below can circulate in space 150 between the inner walls of closet 100 and cabinet 105. An air duct 3100 is connected at a first end to an optional air filter 3105 and thence to the inside of closet 100. The opposite end of duct 3100 is connected to the return port of an air conditioner, heat recovery ventilator, energy recover ventilator, heater, heat pump, dehumidifier, evaporative cooler, air handler or HVAC unit 2800. A duct 3109 conducts air from the supply port of unit 2800 downward into the volume beneath ceiling 135. Optional louvers 3110 direct the supply air away from closet 100 and into the space beneath ceiling 135 so that air is not simply recirculated through closet 100.

Figure 32:
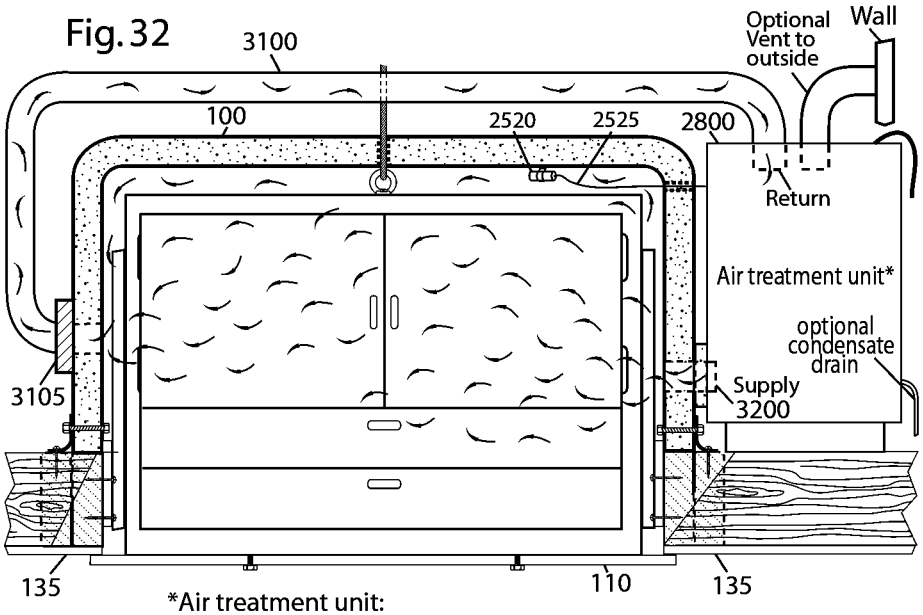
Figure 33A:
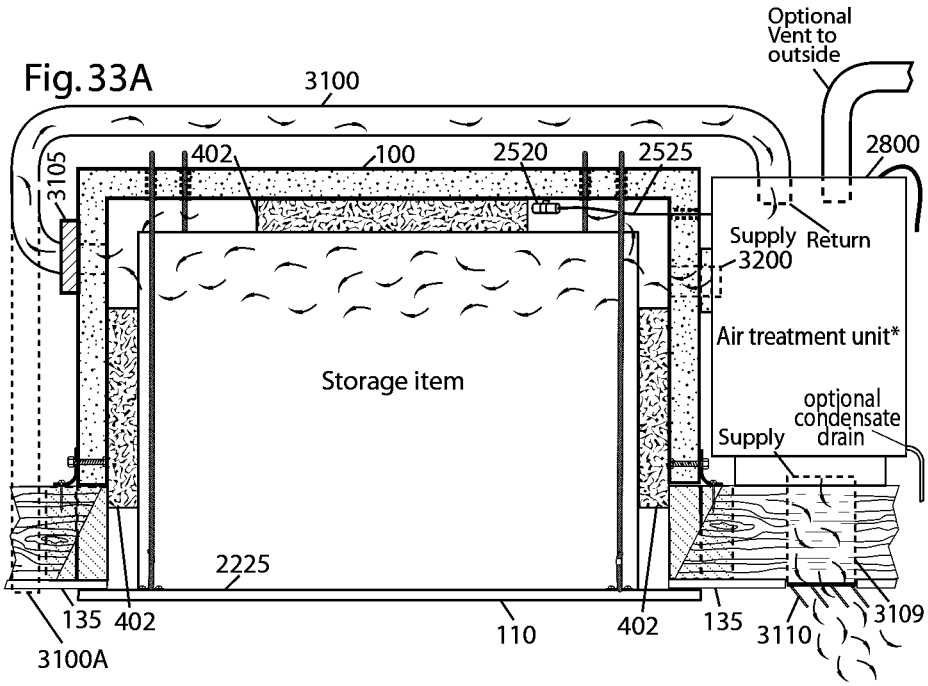
Figure 33B:
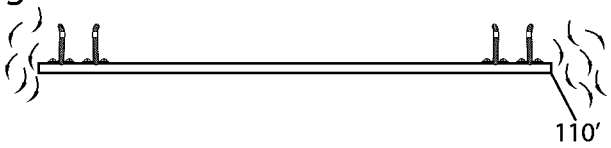

FIG. 32 shows a cut-away side view of a closet 100 with an alternative ducting arrangement. In this aspect, closet 100 is closed at ceiling 135 by a panel 110 that has no vents. A duct 3100 connects at a first end to an optional air filter 3105 and thence to the inside of closet 100. The opposite end of duct 3100 connects to the return port of an air treatment unit 2800, as above. In this aspect, however, air leaving the supply port of unit 2800 is conveyed back into closet 100 by a second duct 3200. Thus in this aspect, air circulates only through closet 100 and unit 2800. FIGS. 33A and 33B show a cut-away side view of a closet 100 with other alternative ducting arrangements connected to an air treatment unit, such as an air conditioner, a heater, a heat pump, a dehumidifier, a heat recovery ventilator, an energy recover ventilator, an evaporative cooler, an air handler or an heating, ventilating and air conditioning unit. FIG. 33A shows a first aspect of these arrangements. In this aspect, closet 100 is closed at ceiling 135 by a panel 110 that has no vents. A duct 3100 connects at a first end to an optional air filter 3105 and thence to the inside of closet 100. The opposite end of duct 3100 connects to the return port of air treatment unit 2800, as above. A second duct 3200 conducts a first portion of supply air from unit 2800 back into duct 3200, and a third duct 3109 conducts a second portion of supply air from unit 2800 downward into the volume beneath ceiling 135. As above, optional louvers 3110 direct air away from panel 110 and closet 100. In addition, an optional section 3100A of duct 3100 returns air to the room beneath ceiling 135.

FIG. 33B shows an alternative arrangement of the present embodiment. In this arrangement, panel 110' is smaller than the opening in ceiling 135 at the bottom of closet 100. Thus, even when panel 110' is fully raised so that the top surface of panel 110' is coplanar with the bottom surface of ceiling 135, air is able to flow between the volume beneath ceiling 135 and the interior space of closet 100.

In FIGS. 31 to 33A, a thermostat or humidistat 2520 is connected to internal controls (not shown) in air treatment unit 2800 and causes unit 2800 to either activate or deactivate in well-known fashion to those familiar with the construction and operation of air treatment units.

Description & Operation

Manually Elevated Cabinet—FIGS. 34 and 35

FIGS. 34 and 35 show side cut-away views of a cabinet system with a manually operated mechanism, in this case a cantilever system for raising and lowering a tiltable cabinet (hereafter "cabinet") 1100 that is arranged to pivot into and out of closet 100 in the attic. FIG. 34 shows cabinet 1100 in its stowed position. Cabinet 1100 is secured at its back side to bent arms 1105. Vent openings 155 are provided between arms 1105 to permit air circulation. Arms 1105 rotate about a pivot 1110 secured between two joists 115 or other structural members. A counterweight 1115 is secured to arm 1105 at the end opposite cabinet 1100 in order to urge arm 1105 to rotate clockwise, thereby urging cabinet 1100 into its stowed position. A spring 1120, such as a coil spring, hydraulic spring, or gas spring, acts to slow the descent of the cabinet when cord 1125 is pulled for access. Manually pushing the lowered bent arm 1105 so that the counterweight 1115 moves past a vertical center line causes the cabinet to elevate into the stowage position with a minimum of effort.

FIG. 35 shows the present system with cabinet 1100 in its fully lowered and accessible position. A cord 1125 is secured to the left-hand end of arm 1105. When access to cabinet 1100 is desired, a user (not shown) merely pulls on cord 1125, thereby lowering cabinet 1100. Cabinet 1100 is returned to its stowed position by lifting the same end upward until the portion of arm 1105 to the left of pivot 1110 is once again horizontal.

Although FIGS. 34 and 35 illustrate only one operational mechanism, there are many other possible variations of a counterbalanced and/or spring loaded manually operated device.

Description & Operation

Figure 38:
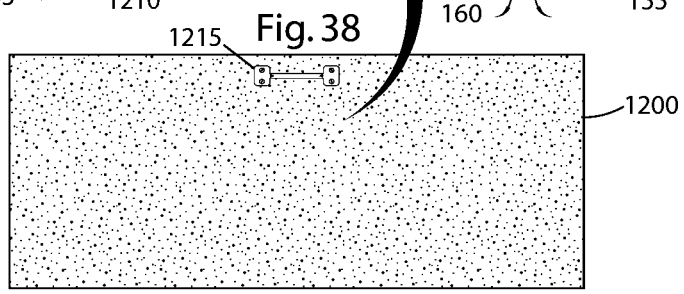

Transporting Objects To Attic—FIGS. 36 to 38

FIGS. 36 to 38 show aspects of another alternative embodiment that is used to transport storage object 2225 between the living space below ceiling 135 and the attic space above ceiling 135 and enable users who have access to the attic to retrieve and move these objects in the attic. Instead of a cabinet 105 (FIG. 1), storage item 2225 rests on panel 110.

FIG. 36 shows a front view of a closet 100" in an attic. A removable access panel 1200 is fitted inserted into an opening 1202 in a wall of closet 100". A handle 1215 on the exterior side of access panel 1200 facilitates removal of access panel 1200 from opening 1202 in closet 100".

Access panel 1200 is secured from within closet 100" by a plurality of tabular fingers 1205 that are secured to the inner walls of closet 100" and spaced inwardly from the outside of closet 100" by the thickness of access panel 1200. A plurality of rotating clasps 1210 secure access panel 1200 to closet 100" so that when clasps 1210 are rotated to their closed positions, as shown in FIG. 36, access panel 1200 is securely held between fingers 1205 and clasps 1210.

FIG. 37 shows a front view of closet 100" with access panel 1200 removed. To remove access panel 1200 from closet 100", a user rotates clasps 1210 to their open positions shown in FIG. 37 and removes access panel 1200 from opening 1202 using handle 1215.

FIG. 38 shows a front view of access panel 1200 and handle 1215 after removal from closet 100". In one aspect, an optional fan 160 and vents 155 are included in panel 110.

To use this embodiment, a user lowers panel 110 into the living space beneath ceiling 135, and places storage item 2225 on the top surface of panel 110. The user then raises panel 110 into the attic space above ceiling 135. The user then enters the attic space via stairs (not shown), removes access panel 1200 from opening 1202 in closet 100" and retrieves the object for placement elsewhere in the attic, if desired. To complete the operation, the user replaces access panel 1200 into opening 1202, and rotates clasps 1210 to their closed position. A user can move objects from the attic space to the living space by reversing these steps.

Description

Cabinet Or Box Stabilization—FIGS. 39 to 41

FIGS. 39 and 40 are side, cutaway views where closet 100 houses a cabinet 105 and FIG. 41 shows an enlarged view of area 41 of FIG. 40. Closet 100 is located near a wall 3905. This system enables the motion of cabinet 105 to be stabilized after it is lowered and is stopped at its lowest position from closet 100. This is done in order to secure cabinet 105 from moving while it is being accessed for loading or unloading of storage items and to prevent cabinet 105 from striking and possibly damaging wall 3905. In one aspect, this is accomplished by installing a pivoting bracket 3900 that is secured to a rear side 3910 of cabinet 105. FIG. 39 shows cabinet 105 and bracket 3900 in their stowed condition.

FIG. 40 shows bracket 3900 in its deployed condition, forming a rigid support between rear side 3910 of cabinet 105 and wall 3905. The sum of the length of arm 4105 plus the radius of wheel 4110 is greater than the distance between cabinet 105 and wall 3905.

FIG. 41 shows an enlarged view of area 41 of FIG. 40, specifically the components of bracket 3900 according to one aspect of the present embodiment. A pivot 4100 is attached to rear surface 3910 of cabinet 105. Pivot 4100 supports a first end of an arm 4105. Pivot 4100 is located in a rotational bracket 4102 that has a stop 4103 that limits the counterclockwise rotational travel of arm 4105. A roller 4110 is located at a second end of arm 4105. A spring 4115 is connected between a central location on arm 4105 and a bracket 4120 that is secured to surface 3910 of cabinet 105.

Operation

When (FIG. 40) cabinet 105 is in its lowered position, a user (not shown) manually pulls cabinet 105 a short distance away from wall 3905 and rotates arm 4105 (FIG. 41) counterclockwise about pivot 4100 until further rotation of arm 4105 is prevented by stop 4103. At this point, arm 4105 is tilted slightly upward. Next, the user releases their pull on cabinet 105 so that arm assembly 3900 holds cabinet 105 a fixed distance away from wall 3905. When cabinet 105 is to be raised into closet 100, the user pulls cabinet 105 a short distance away from wall 3905, thereby releasing arm 4105 and allowing spring 4115 to pull on arm 4105, thereby rotating arm 4105 about pivot 4100 to its lowest position so that bracket 3900 rests against the back surface 3910 of cabinet 105, as shown in FIG. 39.

Description & Operation

Sliding Section Stabilization—FIGS. 42 & 43

FIGS. 42 and 43 show side views of a cabinet 105 in raised and lowered positions, respectively. A pair of channels 4200A and 4200B (FIG. 42) are attached to an inverted T-shaped poker 4205 with an upward-extending leg 4206 that is securely affixed to at least one side of cabinet 105. An upright T-shaped sliding section 4210 slidably moves up and down between channels 4200A and 4200B.

A pair of spring-loaded hooks 4215A and 4215B are secured to pivots 4220A and 4220B at the top of T-section 4210. A first spring 4225A urges hook 4220A to rotate in a clockwise direction. A second spring 4225B urges hook 4220B to rotate in a counter-clockwise direction. A restraining member 4230, such as a metal cable or non-metal cord or a composite of the two, is attached at a first end to hook 4215A and at a second end to hook 4215B. The length of member 4230 is predetermined to permit springs 4225A and 4225B to urge hooks 4220A and 4220B to their vertical positions shown in FIG. 43, in the absence of finger 4206 of poker 4205, i.e., when cabinet 105 is lowered.

When cabinet 105 is raised, the length of finger 4206 is predetermined to raise restraining member 4230, causing hook 4215A to rotate counter-clockwise about pivot 4220A and hook 4215B to rotate clockwise about pivot 4220B.

A pair of catches 4230L and 4230R are secured to joists or framing members 115, 120 above ceiling 135. Catches 4230 include a sloped portion 4232 and a horizontal finger portion 4234.

Lowering Cabinet or Box 105.

As cabinet 105 is lowered from its full elevated location in FIG. 42, finger 4206 becomes disengaged from restraining member 4230 and hooks 4215 are urged by springs 4225 to their outward-most positions, as shown in FIG. 43.

As cabinet 105 is lowered, sliding section 4210 also moves downward, urged by gravity and by frictional forces between channels 4200 and sliding section 4210*e* 4210. As cabinet 105 is lowered further, the lower surface of hooks 4215 comes into contact with the sloped portions 4232 of catches 4230. As cabinet 105 is lowered still further hooks 4215 will ride on the sloped portions 4232 of catches 4230 until hooks 4215 are able to move beneath finger portions 4234 of catches 4230, urged by their associated springs 4220, as shown in FIG. 43. When hooks 4215 are secured within catches 4230, sliding section 4210 is securely restrained and since sliding section 4210 is constrained to move within channels 4200 and since channels 4200 are secured to cabinet 105, cabinet 105 is therefore also restrained from moving and is stabilized.

Raising Cabinet or Box 105.

As cabinet 105 is raised, channels 4200 slidably move upward on sliding section 4210, along with poker 4205 and finger 4206. When finger 4206 reaches restraining member 4230, finger 4206 urges restraining member 4230 upward, thereby urging hooks 4220 to move inward, against the forces exerted by springs 4225. When hooks 4220 move inward and are disengaged from catches 4230, sliding section 4210 also moves upward, finally assuming the position shown in FIG. 42 when cabinet 105 is fully raised.

CONCLUSION, RAMIFICATIONS, AND SCOPE

I have provided an improved attic storage system that uses a closet and a movable panel to retrievably store items in an attic or above a ceiling area. When desired, the panel is lowered into the living space below for access to stored items. While it is raised, the panel forms the floor of the closet. Vent openings in the panel permit air to flow between the living space beneath and the space in the closet, thereby reducing temperature swings that would otherwise occur in the closet, and protecting the contents of the closet from damage due to temperature and humidity extremes. In several aspects, air from air treatment units is recirculated within the closet, ducted so that it is shared with the air in the living space below the closet, or discharged from the closet to the out-of-doors. In one aspect of a first embodiment, a cabinet rests upon a panel. The cabinet and the panel are raised and lowered vertically by a motive force, which can be manual, a spring motor, or electrical means, optionally guided by one or more vertical stabilizing members. In another aspect, a second cabinet is affixed to the bottom side of a panel and the second cabinet remains exposed in the room below the panel when the panel is raised to the ceiling.

In other aspects, air is urged to flow over predetermined surfaces of the cabinet. In another aspect of the first embodiment, a two-piece panel is secured to the ceiling at the perimeter of the closet so that when a cabinet is lowered from the closet, the two halves of the panel springably open and guide the cabinet as it moves up or down. In one aspect of a second embodiment, the cabinet and panel are rotatably raised and lowered on a pivoted cantilever mechanism. The cantilevered mechanism includes a weighted portion opposite the end that supports the cabinet. A weight on the weighted portion moves to the same side of the pivot so that the cabinet will stay in its lowered position. When the cabinet is raised part-way toward the attic, the weight moves to the opposite side of the pivot, urging the cabinet into the ceiling. In another aspect, when the cabinet is stowed, air circulation between the air space in the closet and the room below is enhanced by an electric fan.

In another aspect, a closet and panel are lowered from an attic space into the room below. An optional additional storage cabinet is affixed to the bottom side of the panel for access when the panel and closet are fully raised. In another aspect, spring-loaded doors are arranged to block the vent openings in the panel in case of a fire. The fire doors are normally held open by fusible fire links. When heat from a fire melts the links, they release the doors and airflow between the closet and the room below is blocked, preventing fire from entering the attic. An openable closet permits use of the cabinet for transporting objects between an attic and a living space. Storage bins can be carried within the cabinet.

While the above description contains many specificities, these should not be construed as limitations on the scope, but as exemplifications of some present embodiments. Many other ramifications and variations are possible within the teachings. Additional features can be added, such as decorative graphics, a light fixture, or a television facing into the room below the cabinet. Additional cables can be used to raise and lower a cabinet. An electrical key lock can be used to control the motor that hoists and lowers the cabinet from the attic into the living space. A simple lock mechanism can keep the cantilever embodiment in its stowed position. Such locks are useful when condominium owners wish to securely store their valuables when renting the living space to others, for example. An over-current sensor or a torque-limiting clutch can be added to the hoist motor. This will protect against accidental injury when the cabinet is moving up or down, and also prevent damage to the ceiling structure when the cabinet is overloaded. Limit switches can be employed to prevent excessive up and down movement as can electrical door contact switches, to prevent raising of a cabinet when doors are open. A jacking crank for manual lowering in event of motor or power failure can be integrated into the drive mechanism. Also, the materials and sizes can be changed, as can the shapes of the components. The vertical slides or casters and skids that guide the cabinet into the closet can be eliminated, if desired. In that case, the user would manually guide the cabinet as it is raised. Although the sliding section is T shaped in the illustrations, this floating member can take many shapes, including rectangular, and can have a great variety of means for securing the sliding section to structural members. A remote smoke detector, such as that sold by Flinn Scientific, Inc., Batavia, Ill., can be placed in a closet and/or attic space with the alarm affixed to a panel, ceiling or other location in the living space, so that in the event of smoke or fire above, the alarm is audible below. As indicated, in lieu of the cabinets that are shown and stored in the attic closet, a box or boxes can be stored instead.

Thus the scope should be determined by the appended claims and their legal equivalents, rather than the examples and particulars given.

The invention claimed is:

1. For use in a building with a room below and a room above, where said rooms are separated by a ceiling of said room below, which ceiling has an opening, a system for moving at least one item from said room below and storing said item in said room above, or moving said item from said room above to said room below, comprising:

a raiseable panel that can be raised from a location in said room below to said opening in said ceiling, said panel having at least one vent or opening therein so that air can pass through said at least one vent or opening when said panel is raised to said opening in said ceiling, said panel arranged to seal said opening in said ceiling when said panel is raised to said opening in said ceiling, except for said at least one vent or opening, a closet or enclosure in said room above, said closet or enclosure having a plurality of enclosing walls with inner sides, a top, and a downward-facing opening which communicates with said opening in said ceiling, a fan positioned and arranged to move air through said closet or enclosure when said panel is raised to said ceiling, said fan being positioned at a location selected from the group consisting of adjacent above said vent in said panel, adjacent below said vent in said panel, within said vent in said panel, inside said closet or enclosure, adjacent a duct connected to said closet or enclosure, and within a duct connected to said closet or enclosure, means for (a) raising said panel upward from said location in said room below to said opening in said ceiling so that said panel seals said opening in said ceiling except for said at least one vent or opening, and (b) lowering said panel from said opening in said ceiling to said location in said room below, said panel being capable of supporting a predetermined item so that when said panel is raised to said opening in said ceiling, said item will be located in said closet or enclosure in said room above, and when said panel is lowered to said location in said room below, said item will be accessible in said room below, whereby when said panel is raised to said ceiling, said fan can circulate air through said at least one vent or opening between said room below and said closet or enclosure, so that the temperatures of said room below and said closet or enclosure will tend to equalize when the air in said room below and said closet or enclosure have different temperatures.

2. The system of claim 1, further including at least one sensor, said sensor being selected from the group consisting of thermostats and humidistats, said sensor arranged and positioned to activate said fan to cause airflow through said vent opening.

3. The system of claim 1, further including an accessory cabinet or box, removably attached to said bottom of said panel so that when said panel is raised to said opening in said ceiling, said accessory cabinet or box remains exposed below said ceiling.

4. The system of claim 1, further including an air-treatment unit, selected from the group consisting of an air conditioner, a heater, a heat pump, a dehumidifier, a heat recovery ventilator, an energy recover ventilator, an evaporative cooler, an air handler and a heating, ventilating and air conditioning unit, connected to said closet or enclosure, said air-treatment unit, when energized, being arranged to force treated air through said closet or enclosure, thereby controlling the quality of air in said closet or enclosure.

5. The system of claim 1, further including:

at least one flapper valve over said vent opening, said flapper valve being springably arranged to close said vent opening, at least one fire-link holding said flapper valve in an open position so that air can freely pass between said closet or enclosure and said room below, whereby in the event of a fire, said fire link will release said flapper valve, thereby allowing said flapper valve to close, and prevent said fire from passing between said room below and said closet or enclosure.

6. The system of claim 1, further including a duct connected to said closet or enclosure and said room below, said fan positioned to circulate air, via said duct, between said room below and said closet or enclosure.

7. The system of claim 1 wherein said means for raising said panel and lowering said panel is selected from the class consisting of manually powered and electrically powered means.

8. The system of claim 1, further including at least one closeable opening in said closet or enclosure for providing access to said panel within said room above when said panel is in an elevated position.

9. For use in a building with a room below and a room above, where said rooms are separated by a ceiling of said room below, which ceiling has an opening, a system for moving at least one item from said room below and storing said item in said room above, or moving said item from said room above to said room below, comprising:

a raiseable panel that can be raised from a location in said room below to said opening in said ceiling, a closet or enclosure in said room above, said closet or enclosure having a plurality of enclosing walls with inner sides, a top, and a downward-facing opening which communicates with said opening in said ceiling, a fan arranged to force air through said closet or enclosure when said panel is raised to said ceiling, said fan being positioned at a location selected from the group consisting of inside said closet or enclosure, connected to said closet or enclosure, adjacent a duct connected to said closet or enclosure, within a duct connected to said closet or enclosure, and attached to said panel, means for (a) raising said panel upward from said location in said room below to said opening in said ceiling, and (b) lowering said panel from said opening in said ceiling to said room below, said panel being capable of supporting a predetermined item so that when said panel is raised to said opening in said ceiling, said item will be located in said closet or enclosure in said room above, and when said panel is lowered to said location in said room below, said item will be accessible in said room below, whereby when said panel is raised to said ceiling, said fan can force air through said closet or enclosure.

10. The system of claim 9 wherein said duct connected to said closet or enclosure is also connected to said room below, whereby said fan can circulate air, via said duct, between said room below and said closet or enclosure.

11. The system of claim 9 wherein said panel is smaller than said opening in said ceiling so that said panel, when raised to said ceiling, has at least one space between said panel and said ceiling so that when said panel is raised to said opening in said ceiling, said fan can circulate air between said room below and said closet or enclosure through said space.

12. The system of claim 11, further including:

at least one flapper valve over said space between said panel and said ceiling, said flapper valve being springably arranged to close said space between said panel and said ceiling, at least one fire link holding said flapper valve in an open position so that air can freely pass between said closet or enclosure and said room below, whereby in the event of a fire, said fire link will release said flapper valve, thereby allowing said flapper valve to close, and prevent said fire from passing between said first and second air spaces.

13. The system of claim 11, further including an air filter arranged and positioned to filter air forced through said closet or enclosure.

14. The system of claim 9, further including at least one sensor, said sensor being selected from the group consisting of thermostats and humidistats, said sensor arranged and positioned to activate said fan to cause air to flow through said closet or enclosure.

15. The system of claim 9, further including an air treatment unit, selected from the group consisting of an air conditioner, a heater, a heat pump, a dehumidifier, a heat recovery ventilator, an energy recover ventilator, an evaporative cooler, an air handler and a heating, ventilating and air conditioning unit, connected to said closet or enclosure, which when energized, flows treated air through said closet or enclosure, thereby controlling the quality of air in said closet or enclosure.

16. The system of claim 9 further including an accessory cabinet or box, attached to said bottom of said panel so that when said panel is raised to said opening in said ceiling, said accessory cabinet or box remains exposed below said ceiling.

17. The system of claim 9, further including at least one closeable opening in said closet or enclosure for providing access to said panel within said room above when said panel is in a raised position.

* * * * *